US009382912B2

(12) United States Patent
Shiraichi et al.

(10) Patent No.: US 9,382,912 B2
(45) Date of Patent: Jul. 5, 2016

(54) FAN, MOLDING DIE, AND FLUID FEEDER

(75) Inventors: Yukishige Shiraichi, Osaka (JP); Masaki Ohtsuka, Osaka (JP); Masaya Takahashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 852 days.

(21) Appl. No.: 13/806,915

(22) PCT Filed: May 25, 2011

(86) PCT No.: PCT/JP2011/061985

§ 371 (c)(1),
(2), (4) Date: Dec. 26, 2012

(87) PCT Pub. No.: WO2012/002080

PCT Pub. Date: Jan. 5, 2012

(65) Prior Publication Data

US 2013/0101408 A1 Apr. 25, 2013

(30) Foreign Application Priority Data

Jun. 28, 2010 (JP) ..... 2010-146051

(51) Int. Cl.
*F04D 29/30* (2006.01)
*F04D 17/16* (2006.01)
(Continued)

(52) U.S. Cl.
CPC ..... *F04D 17/16* (2013.01); *F04D 17/04* (2013.01); *F04D 29/023* (2013.01); *F04D 29/282* (2013.01); *F04D 29/283* (2013.01); *F04D 29/30* (2013.01)

(58) Field of Classification Search
CPC ..... F04D 29/30; F04D 29/281; F04D 29/283; F04D 29/289; F04D 29/245; F04D 29/242; F04D 29/68; F04D 29/681; F01D 5/141; F01D 5/145; F05D 2300/44
USPC ..... 416/236 R, 236 A, 236; 415/914
See application file for complete search history.

(56) References Cited

U.S. PATENT DOCUMENTS 3,536,416 A * 10/1970 Glucksman ..... F04D 29/283 29/889.4
5,064,346 A 11/1991 Atarashi et al.
(Continued)

FOREIGN PATENT DOCUMENTS

CN 1813134 A 8/2006
CN 1840313 A 10/2006
(Continued)

OTHER PUBLICATIONS

Official Communication issued in International Patent Application No. PCT/JP2011/061985, mailed on Aug. 23, 2011.

*Primary Examiner* — Dwayne J White
*Assistant Examiner* — Joshua R Beebe
(74) *Attorney, Agent, or Firm* — Keating & Bennett, LLP

(57) ABSTRACT

A cross-flow fan includes a plurality of fan blades. The fan blade has an inner edge portion arranged on an inner circumferential side and an outer edge portion arranged on an outer circumferential side. In the fan blade, a blade surface extending between the inner edge portion and the outer edge portion is formed. As the fan rotates, an air flow which flows between the inner edge portion and the outer edge portion is generated over the blade surface. The fan blade has such a blade cross-sectional shape that a recess is formed in the blade surface. The recess is arranged at a position closer to the outer edge portion than to the inner edge portion and formed to extend from one end to the other end of the fan blade in a direction of a rotation axis of the fan.

9 Claims, 19 Drawing Sheets

(51) Int. Cl.

| | |
|---|---|
| ***F04D 29/28*** | (2006.01) |
| ***F04D 17/04*** | (2006.01) |
| ***F04D 29/02*** | (2006.01) |

(56) References Cited

U.S. PATENT DOCUMENTS

| | | | | |
|---|---|---|---|---|
| 5,114,657 | A * | 5/1992 | Miyajima | B29C 33/0033 249/145 |
| 5,169,290 | A * | 12/1992 | Chou | F01D 5/145 416/223 B |
| 2006/0177304 | A1 * | 8/2006 | Omori | F04D 29/30 415/206 |
| 2006/0263223 | A1 * | 11/2006 | Gustafson | F04D 29/384 416/236 R |
| 2007/0253834 | A1 * | 11/2007 | Ogino | F04D 29/282 417/71 |
| 2010/0115983 | A1 * | 5/2010 | Ikeda | F04D 29/281 62/426 |
| 2010/0158689 | A1 * | 6/2010 | Nishino | F04D 17/04 416/213 A |
| 2013/0101408 | A1 | 4/2013 | Shiraichi et al. | |

FOREIGN PATENT DOCUMENTS

| | | | | |
|---|---|---|---|---|
| CN | 202251075 | U | | 5/2012 |
| JP | 1-318798 | A | | 12/1989 |
| JP | 5-44686 | A | | 2/1993 |
| JP | 7-4388 | A | | 1/1995 |
| JP | 07004388 | A | * | 1/1995 |
| JP | 7-310696 | A | | 11/1995 |
| JP | 2669448 | B2 | | 10/1997 |
| JP | 2007-10259 | A | | 1/2007 |
| JP | 2010-106853 | A | | 5/2010 |
| JP | 2010-174852 | A | | 8/2010 |

* cited by examiner

FAN, MOLDING DIE, AND FLUID FEEDER

TECHNICAL FIELD

This invention generally relates to a fan, a molding die, and a fluid feeder, and more particularly to such a fan as a cross-flow fan or a centrifugal fan, a molding die used for manufacturing the fan, and a fluid feeder including the fan.

BACKGROUND ART

With regard to a conventional fan, for example, Japanese Patent Laying-Open No. 1-318798 discloses an impeller of a multiblade blower aiming to mitigate wind noise, n sound (n: the number of revolutions) or the like and further to distribute wake flow vortexes (PTL 1). In the impeller of the multiblade blower disclosed in PTL 1, a columnar portion having a diameter greater than a thickness at a tip end of a blade is provided at a tip end of the blade on an outer circumferential side of a fan.

In addition, Japanese Patent Laying-Open No. 5-44686 discloses a highly efficient tangential fan low in noise level (PTL 2). In the tangential fan disclosed in PTL 2, a back side of a blade of an impeller is formed to decrease in thickness toward an outer circumferential side.

CITATION LIST

Patent Literature

PTL 1: Japanese Patent Laying-Open No. 1-318798
PTL 2: Japanese Patent Laying-Open No. 5-44686

SUMMARY OF INVENTION

Technical Problem

In such an electric appliance as an air conditioner or an air cleaner, a fan for sending air into a room is contained. Since quietness during operation is required in these electric appliances, noise involved with rotation of the fan should be reduced.

A cause of generated noise is, for example, passage of an end of a fan blade in a constant cycle as a fan rotates. In this case, pressure fluctuation in a constant cycle takes place in the inside of a fan casing covering the fan, and narrow-band noise called vane passing sound (nZ sound: sound of which frequency is determined by a value calculated by multiplying a natural number n by the number of fan blades Z) is generated. As measures for reducing such narrow-band noise, such measures as arranging fan blades at random pitches in a circumferential direction and arranging fan blades as being displaced among a plurality of impellers aligned in a direction of a rotation axis are possible.

With non-uniform arrangement of fan blades as above, however, in arrangement of fan blades in a circumferential direction, there will be a fan blade arranged as being deviated from an interval optimal in terms of design, which is derived in consideration of air blow capability. Therefore, such a problem as lowering in air blow capability or increase in power consumption in a drive motor for rotating the fan arises. In contrast, if an attempt to optimize intervals among all fan blades is made, all intervals become equal and nZ sound becomes high.

On the other hand, the impeller of the multiblade blower disclosed in PTL 1 described above aims to reduce noise by providing the columnar portion at the tip end on the outer circumferential side of the fan. The columnar portion, however, is provided at a portion originally small in thickness and hence there is a concern that weight of the fan increases and power consumption in the drive motor increases. While the fan is operated at a low rotation speed, generation of nZ sound does not give rise to a serious problem. Therefore, the columnar portion unduly narrows an air flow path between fan blades, which becomes a factor for undue increase in power consumption in the drive motor.

In addition, since the back side of the blade of the impeller is formed to decrease in thickness toward the outer circumference in the tangential fan disclosed in PTL 2 described above, the fan is advantageous in that power consumption in the drive motor is reduced. Such a shape of the blade, however, narrows a width for a flow of air which flows along the blade and a wake flow in the downstream of the blade is concentrated. Therefore, a sufficient effect for reducing primary sound of the nZ sound cannot be obtained.

Therefore, an object of this invention is to solve the above-described problems and to provide a fan achieving excellent air blow capability and reduction in noise, a molding die, and a fluid feeder.

Solution to Problem

A fan according to this invention includes a plurality of vane portions provided at a distance from one another in a circumferential direction. The vane portion has an inner edge portion arranged on an inner circumferential side and an outer edge portion arranged on an outer circumferential side. The vane portion has a blade surface formed, which extends between the inner edge portion and the outer edge portion. As the fan rotates, a fluid flow which flows between the inner edge portion and the outer edge portion is generated over the blade surface. The vane portion has such a blade cross-sectional shape that a recess is formed in the blade surface when it is cut in a plane orthogonal to a rotation axis of the fan. The recess is arranged at a position closer to the outer edge portion than to the inner edge portion and formed to extend from one end to the other end of the vane portion in a direction of the rotation axis of the fan.

According to the fan thus constructed, as air flows between adjacent vane portions, a vortex (a secondary flow) of a fluid flow is generated in the recess and a fluid flow (a main flow) which passes over the blade surface flows along the outside of the vortex generated in the recess. Here, a size or a shape of the vortex generated in the recess changes under the influence by a velocity of an air flow which passes between the adjacent vane portions or slight disturbance, and with this change, an air flow which flows along the outside of the vortex also significantly changes. Therefore, in the downstream of the recess, temporal fluctuation is caused in a direction or a velocity of the fluid flow which passes over the blade surface so that generation of noise due to periodic passage of the vane portion can be suppressed. Meanwhile, according to the present invention, since generation of noise can be suppressed by forming the recess, a shape or arrangement of each vane portion can be optimized in consideration of air blow capability. Therefore, a fan achieving excellent air blow capability and reduction in noise can be realized.

Further preferably, the blade surface is constituted of a positive pressure surface arranged on a side of a direction of rotation of the fan and a negative pressure surface arranged on a back side of the positive pressure surface. The recess is formed in the negative pressure surface.

According to the fan thus constructed, since a pressure applied to the fluid flow which passes over the blade surface is lower on the negative pressure surface than on the positive pressure surface, with change in size or shape of the vortex generated in the recess, in the downstream of the recess, separation and reattachment of a fluid flow from and to the blade surface take place. Therefore, greater temporal fluctuation is caused in a direction or a velocity of the fluid flow which passes over the blade surface and generation of noise due to periodic passage of the vane portion can effectively be suppressed.

Further preferably, the recess is formed such that its cross-sectional shape changes from one end to the other end of the vane portion in the direction of the rotation axis of the fan. According to the fan thus constructed, a size or a shape of the vortex generated in the recess can be changed in the direction of the rotation axis of the fan and generation of noise can more effectively be suppressed.

Further preferably, the recess is formed such that a width of opening in the blade surface changes from one end to the other end of the vane portion in the direction of the rotation axis of the fan. According to the fan thus constructed, since a length of contact between the vortex generated in the recess and the fluid flow which flows along the outside thereof changes, greater change can be caused in a size or a shape of the vortex generated in the recess in the direction of the rotation axis of the fan.

Further preferably, when cut in a plane orthogonal to the rotation axis of the fan, the vane portion has a cross-sectional area increasing from one end toward the other end of the vane portion in the direction of the rotation axis of the fan. The recess is formed such that a cross-sectional area of the recess recessed in the blade surface is greater on a side of the other end than on a side of one end of the vane portion.

According to the fan thus constructed, a size or a shape of the vortex generated in the recess can be changed in the direction of the rotation axis of the fan and generation of noise can more effectively be suppressed. Here, since the recess is formed such that its cross-sectional area is greater on the other end side where a cross-sectional area of the vane portion is greater, strength of the vane portion can sufficiently be ensured in spite of formation of the recess.

Further preferably, the plurality of the vane portions include a first vane portion and a second vane portion different in form of the recess formed in the vane portion.

According to the fan thus constructed, as a form of the recess formed in the vane portion is different, a shape, a size, or the number of vortexes of the fluid flow formed in the recess is different between the first vane portion and the second vane portion. In this case, since the fluid flow which flows along the outside of the vortex is also affected by the shape, the size, or the number of vortexes, a direction or a velocity of the fluid flow in the downstream of the recess can be varied between the first vane portion and the second vane portion. Thus, generation of noise can further effectively be suppressed.

Further preferably, in the inside of the plurality of vane portions aligned in the circumferential direction, an inner space is formed, and on the outside thereof, an outer space is formed. The fan described in any part above is a cross-flow fan for taking a fluid from the outer space on one side with respect to the rotation axis into the inner space when viewed in the direction of the rotation axis of the fan and sending the taken fluid to the outer space on the other side with respect to the rotation axis. According to the fan thus constructed, a cross-flow fan achieving excellent air blow capability and reduction in noise can be obtained.

Further preferably, in the inside of the plurality of vane portions aligned in the circumferential direction, an inner space is formed, and on the outside thereof, an outer space is formed. The fan described in any part above is a centrifugal fan for sending a fluid from the inner space to the outer space. According to the fan thus constructed, a centrifugal fan achieving excellent air blow capability and reduction in noise can be obtained.

Further preferably, the fan described in any part above is formed from resin. According to the fan thus constructed, a fan made of resin, which achieves excellent air blow capability and reduction in noise, can be obtained.

A molding die according to this invention is used for molding the fan described in any part above. According to the molding die thus constructed, a fan made of resin can be manufactured.

A fluid feeder according to this invention includes a blower constituted of the fan described in any part above and a drive motor coupled to the fan to rotate the plurality of vane portions. According to the fluid feeder thus constructed, as air blow capability of the fan improves, power consumption in the drive motor can be reduced.

Advantageous Effects of Invention

As described above, according to this invention, a fan achieving excellent air blow capability and reduction in noise, a molding die, and a fluid feeder can be provided.

DESCRIPTION OF EMBODIMENTS

Figure 1:
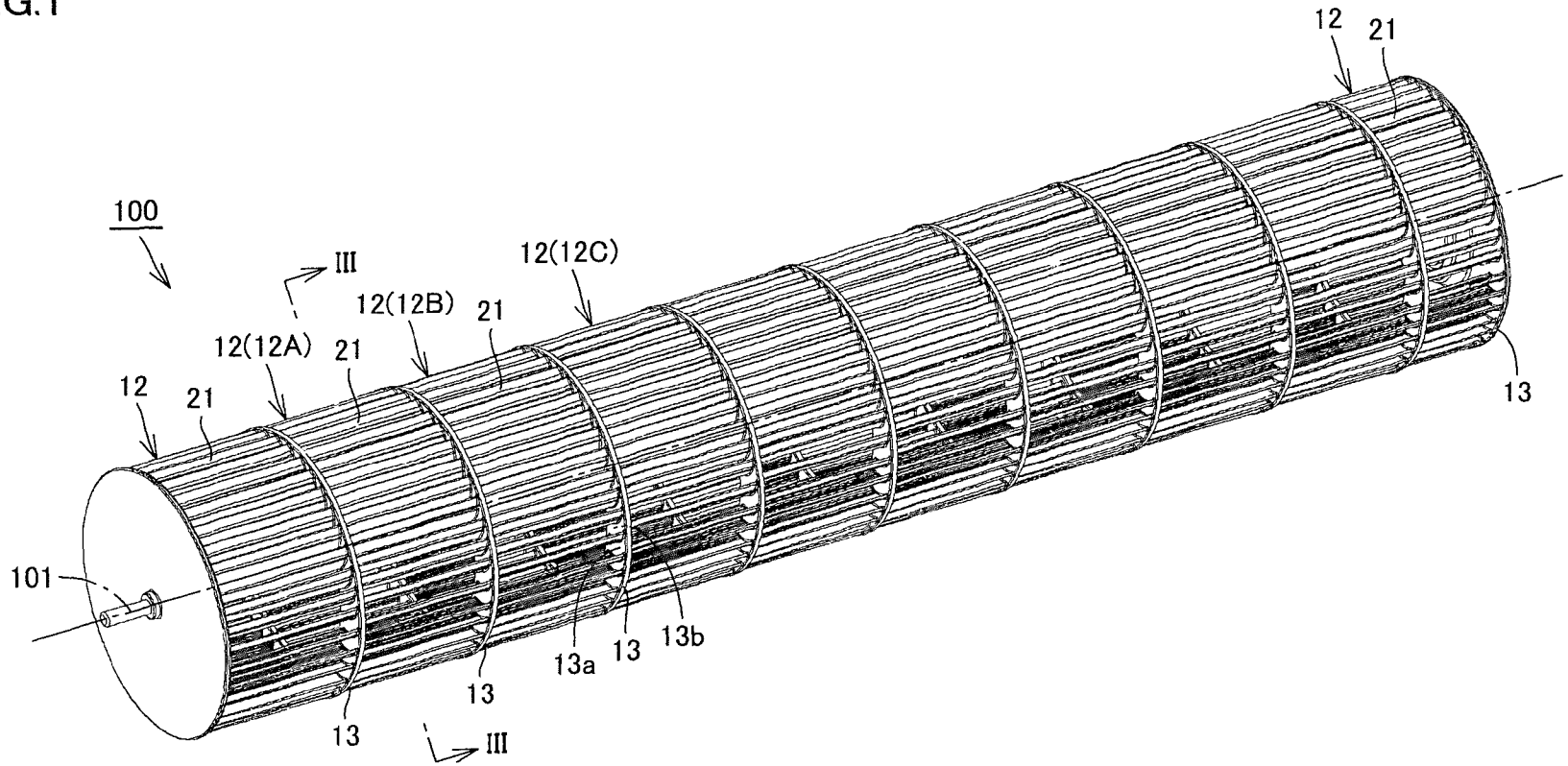
FIG. 1 is a perspective view showing a cross-flow fan in a first embodiment of this invention.

An embodiment of this invention will be described with reference to the drawings. It is noted that the same or corresponding members have the same numbers allotted in the drawings referred to below.

[First Embodiment]

(Description of Structure of Cross-Flow Fan)

Figure 2:
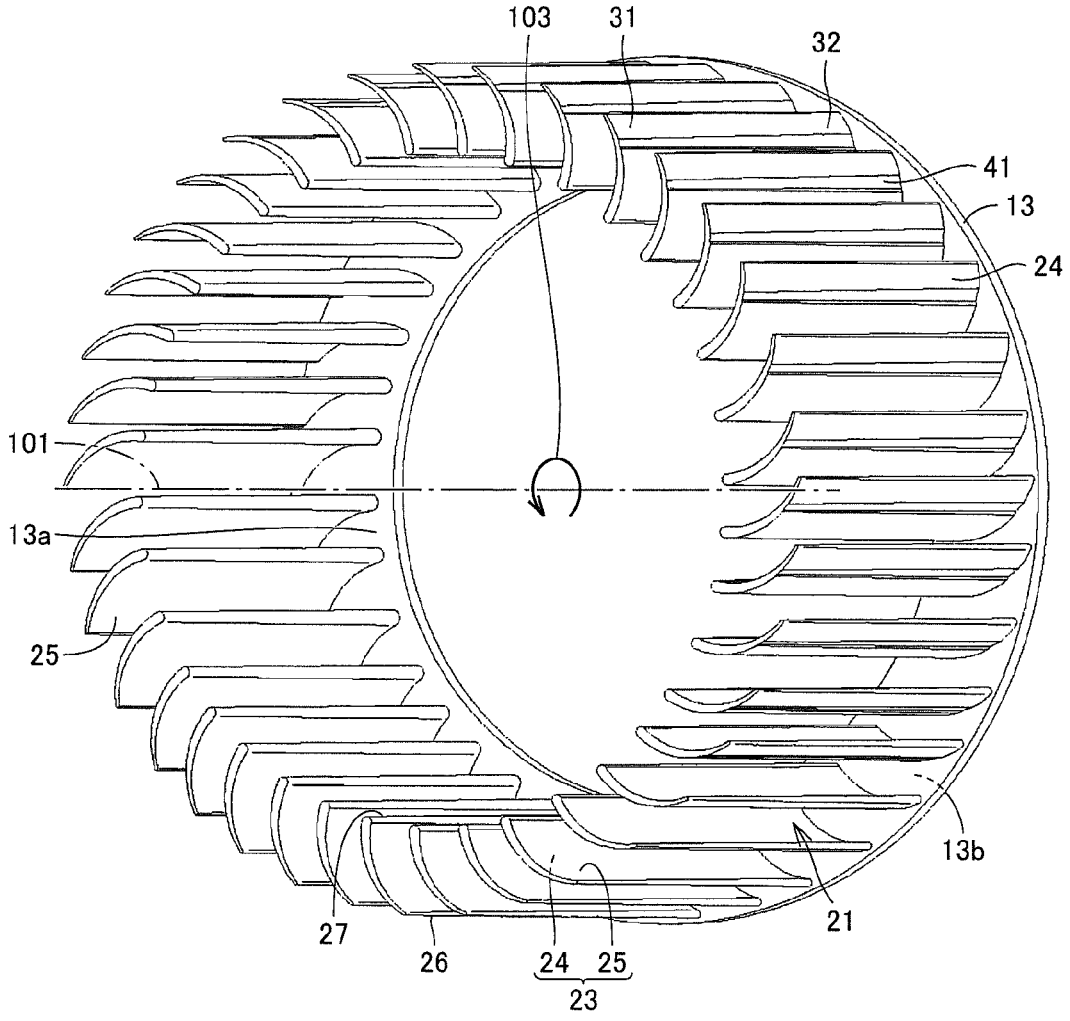
FIG. 2 is a perspective view showing one of impellers constituting the cross-flow fan in FIG. 1.
Figure 3:
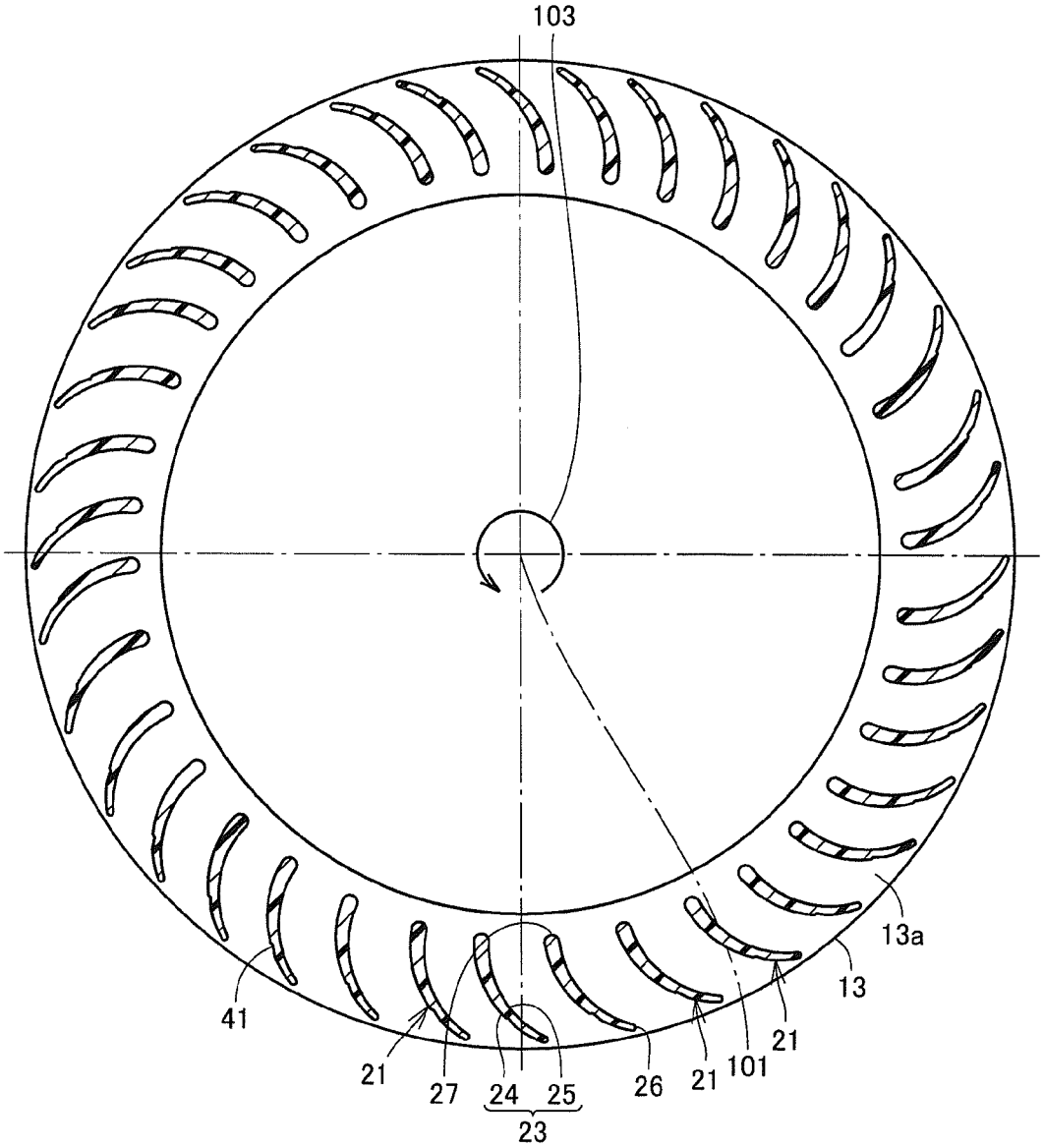
FIG. 3 is a cross-sectional view showing the cross-flow fan along the line III-III in FIG. 1.

FIG. 1 is a perspective view showing a cross-flow fan in a first embodiment of this invention. FIG. 2 is a perspective view showing one of impellers constituting the cross-flow fan in FIG. 1. FIG. 3 is a cross-sectional view showing the cross-flow fan along the line III-III in FIG. 1.

Referring to FIGS. 1 to 3, a cross-flow fan 100 in the present embodiment has a plurality of fan blades 21. Cross-flow fan 100 has appearance in a substantially cylindrical shape as a whole and the plurality of fan blades 21 are arranged around a circumferential surface of the substantially cylindrical shape. Cross-flow fan 100 is integrally formed from resin. Cross-flow fan 100 rotates in a direction shown with an arrow 103, around a virtual central axis 101 shown in the figure.

Cross-flow fan 100 is a fan sending air in a direction orthogonal to central axis 101 which is a rotation axis, by using the plurality of rotating fan blades 21. Cross-flow fan 100 is such a fan that, when viewed in an axial direction of central axis 101, air is taken into an inner space of the fan from an outer space on one side with respect to central axis 101 and then taken air is sent to the outer space on the other side with respect to central axis 101. Cross-flow fan 100 forms an air flow which flows in a direction intersecting central axis 101 in a plane orthogonal to central axis 101. Cross-flow fan 100 forms a planar blown flow in parallel to central axis 101.

Cross-flow fan 100 is used at the number of revolutions in a range of low Reynolds numbers applied to fans in home electric appliances or the like.

Cross-flow fan 100 is constructed in such a manner that a plurality of impellers 12 aligned in an axial direction of central axis 101 are combined. In each impeller 12, the plurality of fan blades 21 are provided at a distance from one another in a circumferential direction around central axis 101.

Cross-flow fan 100 further has an outer circumferential frame 13 serving as a support portion. Outer circumferential frame 13 has a ring shape as extending annularly around central axis 101. Outer circumferential frame 13 has an end surface 13*a* and an end surface 13*b*. End surface 13*a* is formed to face one direction along the axial direction of central axis 101. End surface 13*b* is arranged on a back side of end surface 13*a* and formed to face the other direction along the axial direction of central axis 101.

Outer circumferential frame 13 is provided to lie between adjacent impellers 12 in the axial direction of central axis 101.

Attention being paid to an impeller 12A and an impeller 12B in FIG. 1 arranged adjacent to each other, the plurality of fan blades 21 provided in impeller 12A are formed to be erected on end surface 13*a* and to extend like a plate along the axial direction of central axis 101. The plurality of fan blades 21 provided in impeller 12B are formed to be erected on end surface 13*b* and to extend like a plate along the axial direction of central axis 101.

In a process for manufacturing cross-flow fan 100, impeller 12 shown in FIG. 2 is manufactured with resin molding. In addition, a form of cross-flow fan 100 in FIG. 1 is obtained by connecting the plurality of obtained impellers 12 to one another.

FIG. 3 shows a blade cross-section of fan blades 21 in the case where they are cut in a plane orthogonal to central axis 101 which is the rotation axis of cross-flow fan 100.

Referring to FIGS. 2 and 3, fan blade 21 has an inner edge portion 27 and an outer edge portion 26. Inner edge portion 27 is arranged on an inner circumferential side of fan blade 21. Outer edge portion 26 is arranged on an outer circumferential side of fan blade 21. Fan blade 21 is formed as being inclined in a circumferential direction around central axis 101 from inner edge portion 27 toward outer edge portion 26. Fan blade 21 is formed as being inclined in a direction of rotation of cross-flow fan 100 from inner edge portion 27 toward outer edge portion 26.

In fan blade 21, a blade surface 23 constituted of a positive pressure surface 25 and a negative pressure surface 24 is formed. Positive pressure surface 25 is arranged on a side in a direction of rotation of cross-flow fan 100 and negative pressure surface 24 is arranged on a back side of positive pressure surface 25. As an air flow is generated over blade surface 23 during rotation of cross-flow fan 100, such pressure distribution that pressure is relatively high on positive pressure surface 25 and it is relatively low on negative pressure surface 24 is produced. Fan blade 21 has a blade cross-section curved as a whole between inner edge portion 27 and outer edge portion 26 such that a positive pressure surface 25 side is concave and a negative pressure surface 24 side is convex. Fan blade 21 is formed to have a thin blade cross-section between inner edge portion 27 and outer edge portion 26.

Figure 4:
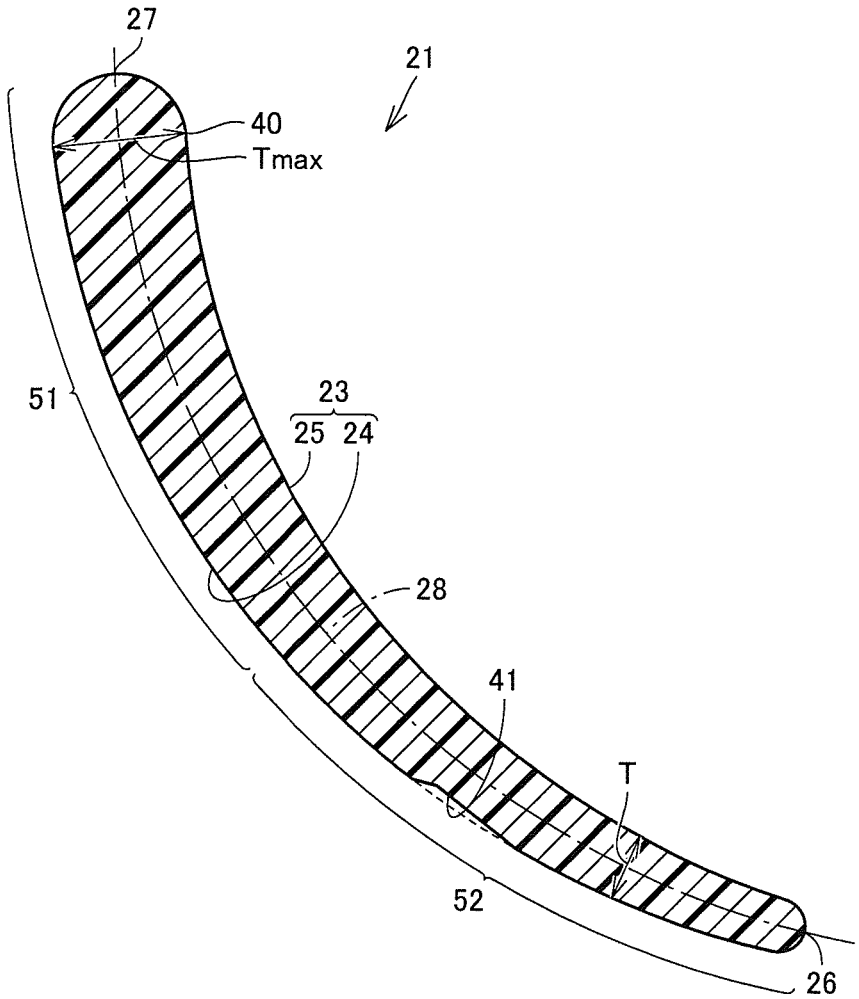
FIG. 4 is a cross-sectional view showing a fan blade included in the cross-flow fan in FIG. 1.

FIG. 4 is a cross-sectional view showing a fan blade included in the cross-flow fan in FIG. 1. Referring to FIG. 4, the figure shows a centerline 28 with respect to a direction of thickness (a direction connecting positive pressure surface 25 and negative pressure surface 24 to each other) of the blade cross-section of fan blade 21.

Centerline 28 extends through the blade cross-section to divide the blade cross-section of fan blade 21 into the positive pressure surface 25 side and the negative pressure surface 24 side. Centerline 28 may be defined by a single arc or by combination of a plurality of arcs different in curvature. Fan blade 21 has inner edge portion 27 at a tip end where centerline 28 extends toward the inner circumferential side and outer edge portion 26 at a tip end where centerline 28 extends toward the outer circumferential side. Centerline 28 extends as being curved between inner edge portion 27 and outer edge portion 26. It is noted that, at a position where a recess 41 which will be described later is formed, centerline 28 is shown to extend through a central position between blade surfaces 23 in the absence of recess 41 as shown with a dotted line in FIG. 4.

Positive pressure surface 25 and negative pressure surface 24 each extend as being curved between inner edge portion 27 and outer edge portion 26. In the case where a length between positive pressure surface 25 and negative pressure surface 24 is referred to as a thickness of fan blade 21, fan blade 21 has a thickness T at an arbitrary position between inner edge portion 27 and outer edge portion 26. In the present embodiment, thickness T of fan blade 21 is zero at inner edge portion 27 and outer edge portion 26. Thickness T of the fan blade continuously changes between inner edge portion 27 and outer edge portion 26.

On blade surface 23 of fan blade 21, an inner circumferential side region 51 closer to inner edge portion 27 than to outer edge portion 26 and an outer circumferential side region 52 closer to outer edge portion 26 than to inner edge portion 27 are defined. Namely, in a direction of extension of centerline 28 connecting inner edge portion 27 and outer edge portion 26 to each other, inner circumferential side region 51 is arranged on an inner edge portion 27 side and outer circumferential side region 52 is arranged on an outer edge portion 26 side. A length of blade surface 23 (positive pressure surface 25 or negative pressure surface 24) between a position of boundary between inner circumferential side region 51 and outer circumferential side region 52 and inner edge portion 27 is equal to a length of blade surface 23 (positive pressure surface 25 or negative pressure surface 24) between the position of boundary between inner circumferential side region 51 and outer circumferential side region 52 and outer edge portion 26.

Fan blade 21 has a large-thickness portion 40. Fan blade 21 has a greatest thickness $T_{max}$ at large-thickness portion 40 on centerline 28 connecting inner edge portion 27 and outer edge portion 26 to each other. Thickness T of fan blade 21 increases from inner edge portion 27 toward large-thickness portion 40, attains to maximum at large-thickness portion 40, and then decreases from large-thickness portion 40 toward outer edge portion 26.

Large-thickness portion 40 is arranged closer to any one of inner edge portion 27 and outer edge portion 26. In the present embodiment, large-thickness portion 40 is arranged closer to inner edge portion 27, of inner edge portion 27 and outer edge portion 26. Large-thickness portion 40 is arranged in inner circumferential side region 51 closer to inner edge portion 27 than to outer edge portion 26. Large-thickness portion 40 is arranged adjacent to inner edge portion 27. Large-thickness portion 40 is arranged at a position where a length of blade surface 23 between inner edge portion 27 and large-thickness portion 40 is smaller than a length of blade surface 23 between large-thickness portion 40 and the position of boundary between inner circumferential side region 51 and outer circumferential side region 52. Fan blade 21 has such a blade cross-section that a thickness is relatively great on the inner circumferential side and relatively small on the outer circumferential side as a whole.

Fan blade 21 has an aerofoil cross-section having large-thickness portion 40 arranged closer to any one of inner edge portion 27 and outer edge portion 26 when it is cut in a plane orthogonal to central axis 101.

Referring to FIGS. 2 to 4, recess 41 is formed in fan blade 21. Recess 41 is formed to be recessed in blade surface 23. Recess 41 is formed at a position closer to outer edge portion 26 than to inner edge portion 27, that is, in outer circumferential side region 52. No recess is formed at a position closer to inner edge portion 27 than to outer edge portion 26, that is, in inner circumferential side region 51.

In the present embodiment, recess 41 is formed in negative pressure surface 24. No recess is formed in positive pressure surface 25. Recess 41 is formed in any one of positive pressure surface 25 and negative pressure surface 24. In negative pressure surface 24, blade surface 23 becomes discontinuous at a position between inner edge portion 27 and outer edge portion 26, where recess 41 is formed. In positive pressure surface 25 where no recess is formed, blade surface 23 extends continuously between inner edge portion 27 and outer edge portion 26.

As shown in FIG. 2, fan blade 21 extends between one end 31 and the other end 32 in the axial direction of central axis 101. In the form of cross-flow fan 100 shown in FIG. 1, one end 31 is connected to end surface 13*b* of outer circumferential frame 13, and the other end 32 is connected to end surface 13*a* of outer circumferential frame 13.

Recess 41 is in a shape of a groove extending along the axial direction of central axis 101. Recess 41 is formed to extend continuously between one end 31 and the other end 32 of fan blade 21 in the axial direction of central axis 101. Recess 41 is formed to extend linearly between one end 31 and the other end 32 of fan blade 21 in the axial direction of central axis 101.

Recess 41 has a triangular cross-section when cut in a plane orthogonal to central axis 101. Recess 41 is not limited to such a shape, and for example, it may have a trapezoidal or arc-shaped cross-section.

Referring to FIGS. 1 to 3, the plurality of fan blades 21 have an identical blade cross-sectional shape. In the case where fan blades 21 are rotated around central axis 101, blade surfaces 23 overlap one another among the plurality of fan blades 21. In the case where fan blades 21 are rotated around central axis 101, inner edge portions 27 and outer edge portions 26 overlap one another among the plurality of fan blades 21. The plurality of fan blades 21 are aligned such that a pitch between adjacent fan blades is random. Such a random pitch is realized, for example, by arranging the plurality of fan blades 21 at irregular intervals in accordance with random number normal distribution.

A plurality of impellers 12 are formed such that alignment of fan blades is the same among them. Namely, an interval at which the plurality of fan blades 21 are aligned in each impeller 12 and an order of fan blades 21 aligned at those intervals are the same among the plurality of impellers 12.

It is noted that the plurality of fan blades 21 may be aligned at regular pitches, without being limited to random pitches.

The plurality of impellers 12 are stacked such that a displacement angle R is produced between adjacent impellers 12 when viewed in the axial direction of central axis 101. For example, attention being paid to impeller 12A, impeller 12B, and an impeller 12C in FIG. 1 adjacently arranged in the order mentioned, impeller 12B is stacked such that it is displaced with respect to impeller 12A by displacement angle R around central axis 101 from a position where all fan blades 21 of impeller 12A and impeller 12B overlap in the axial direction of central axis 101. In addition, impeller 12C is stacked such that it is displaced with respect to impeller 12B by displacement angle R (2R when viewed from impeller 12A) around central axis 101 from a position where all fan blades 21 of impeller 12B and impeller 12C overlap in the axial direction of central axis 101.

(Description of Structure of Air Conditioner and Molding Die)

Figure 5:
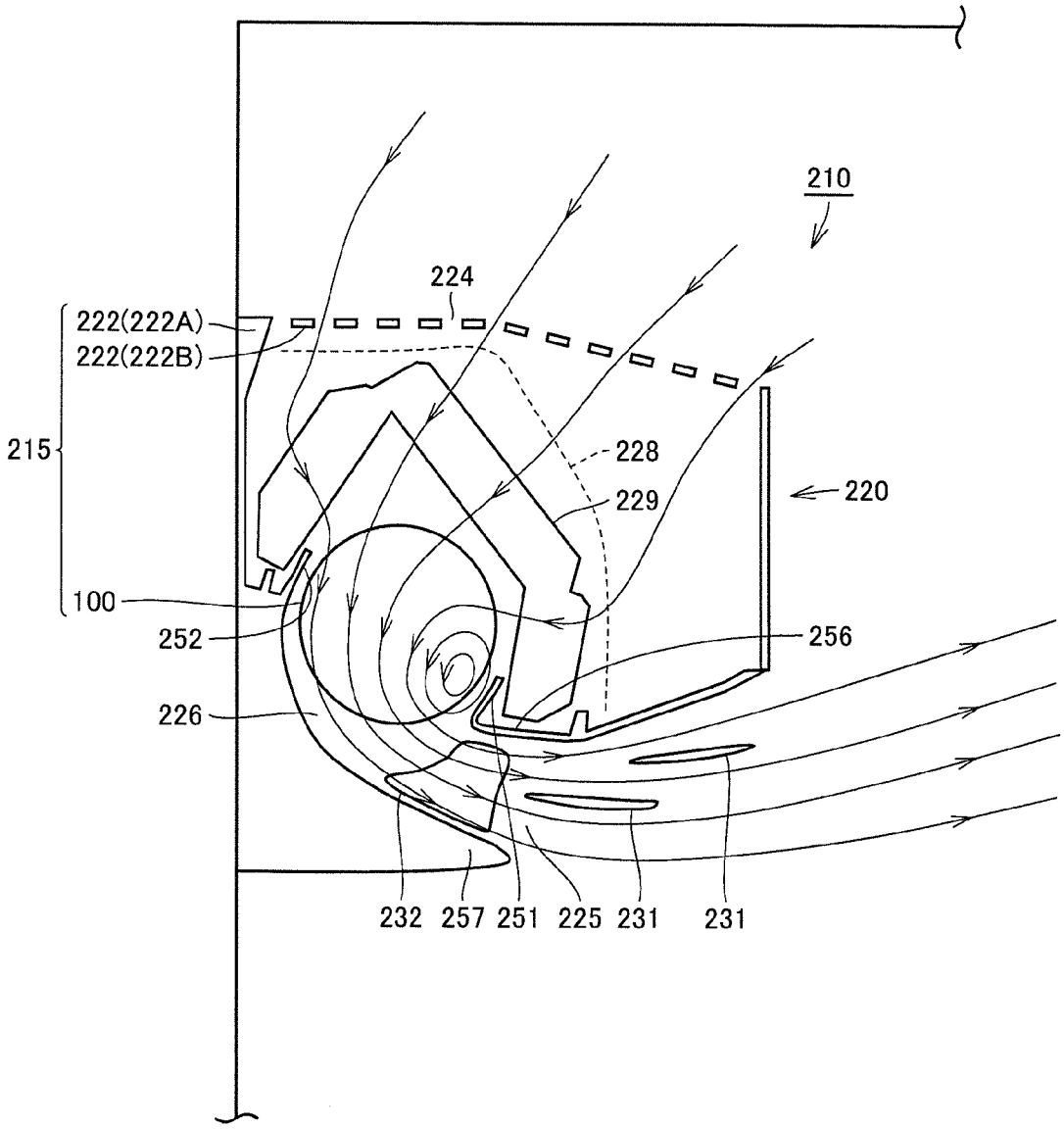
FIG. 5 is a cross-sectional view showing an air conditioner in which the cross-flow fan in FIG. 1 is employed.

FIG. 5 is a cross-sectional view showing an air conditioner in which the cross-flow fan in FIG. 1 is employed. Referring to FIG. 5, an air conditioner 210 includes an indoor unit 220 placed in a room and provided with an indoor heat exchanger 229 and a not-shown outdoor unit placed outside the room and provided with an outdoor heat exchanger and a compressor. Indoor unit 220 and the outdoor unit are connected to each other by a pipe for circulating a refrigerant gas between indoor heat exchanger 229 and the outdoor heat exchanger.

Indoor unit 220 has a blower 215. Blower 215 has cross-flow fan 100, a not-shown drive motor for rotating cross-flow fan 100, and a casing 222 for generating a prescribed air current along with rotation of cross-flow fan 100.

Casing 222 has a cabinet 222A and a front panel 222B. Cabinet 222A is supported on a wall surface in the room, and front panel 222B is removably attached to cabinet 222A. An outlet port 225 is formed in a gap between a lower end portion of front panel 222B and a lower end portion of cabinet 222A. Outlet port 225 is formed in a substantially rectangular shape extending in a width direction of indoor unit 220 and provided to face down forward. An upper surface of front panel 222B has an intake port 224 formed in a lattice shape.

At a position opposed to front panel 222B, an air filter 228 is provided to catch and remove dust included in air sucked through intake port 224. A not-shown air filter cleaning apparatus is provided in a space formed between front panel 222B and air filter 228. The air filter cleaning apparatus automatically removes dust accumulated in air filter 228.

An air-blow passage 226 through which air flows from intake port 224 toward outlet port 225 is formed inside casing 222. Outlet port 225 is provided with a vertical louver 232 capable of changing an angle of blowing in right and left directions and a plurality of lateral louvers 231 capable of changing an angle of vertical blowing in forward and upward, horizontal, forward and downward, and downward directions.

Indoor heat exchanger 229 is arranged between cross-flow fan 100 and air filter 228 in a path of air-blow passage 226. Indoor heat exchanger 229 has not-shown winding refrigerant pipes arrayed in a plurality of stages in a vertical direction and a plurality of rows in a front-back direction in parallel to one another. Indoor heat exchanger 229 is connected to the compressor of the outdoor unit placed outside the room, and a refrigeration cycle is operated by drive of the compressor. As the refrigeration cycle is operated, indoor heat exchanger 229 is cooled to a temperature lower than ambient temperature during cooling operation, and indoor heat exchanger 229 is heated to a temperature higher than ambient temperature during heating operation.

Figure 6:
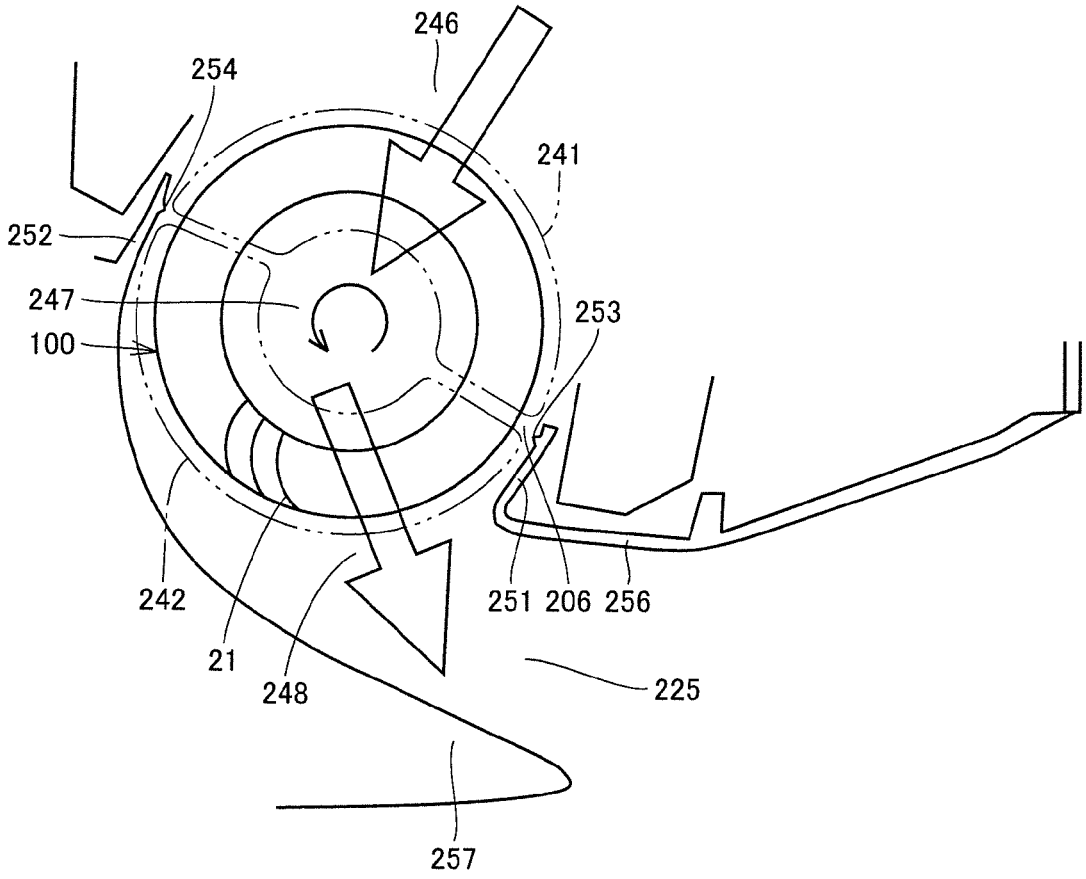
FIG. 6 is a cross-sectional view showing in an enlarged view, a portion in the vicinity of an outlet port of the air conditioner in FIG. 5.

FIG. 6 is a cross-sectional view showing in an enlarged view, a portion in the vicinity of the outlet port of the air conditioner in FIG. 5. Referring to FIGS. 5 and 6, casing 222 has a front wall portion 251 and a rear wall portion 252. Front wall portion 251 and rear wall portion 252 are arranged to face each other at a distance from each other.

In the path of air-blow passage 226, cross-flow fan 100 is arranged to be located between front wall portion 251 and rear wall portion 252. Front wall portion 251 has a projection 253 formed, which projects toward an outer circumferential surface of cross-flow fan 100 to minimize a gap between cross-flow fan 100 and front wall portion 251. Rear wall portion 252 has a projection 254 formed, which projects toward the outer circumferential surface of cross-flow fan 100 to minimize a gap between cross-flow fan 100 and rear wall portion 252.

Casing 222 has an upper guide portion 256 and a lower guide portion 257. Air-blow passage 226 is defined by upper guide portion 256 and lower guide portion 257 in the air flow downstream of cross-flow fan 10.

Upper guide portion 256 and lower guide portion 257 are continuous from front wall portion 251 and rear wall portion 252 respectively and extend toward outlet port 225. Upper guide portion 256 and lower guide portion 257 are formed such that air sent from cross-flow fan 100 is curved with upper guide portion 256 being located on the inner circumferential side and lower guide portion 257 being located on the outer circumferential side and guided down forward. Upper guide portion 256 and lower guide portion 257 are formed such that a cross sectional area of air-blow passage 226 increases from cross-flow fan 100 toward outlet port 225.

According to the present embodiment, front wall portion 251 and upper guide portion 256 are formed to be integral with front panel 222B. Rear wall portion 252 and lower guide portion 257 are formed to be integral with cabinet 222A.

Figure 7:
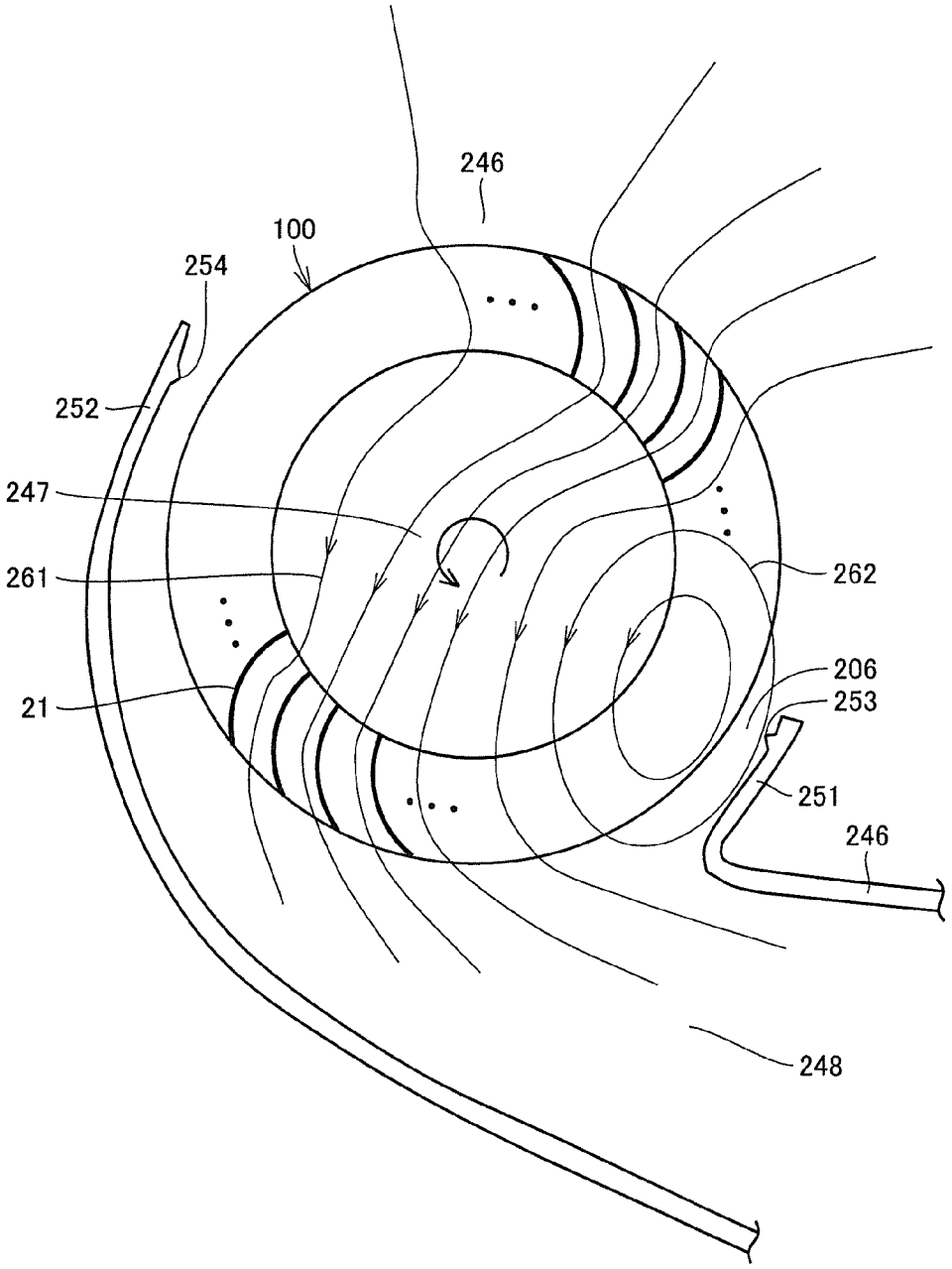
FIG. 7 is a cross-sectional view showing an air flow generated in the vicinity of the outlet port of the air conditioner in FIG. 5.

FIG. 7 is a cross-sectional view showing an air flow generated in the vicinity of the outlet port of the air conditioner in FIG. 5. Referring to FIGS. 5 to 7, on the path of air-blow passage 226, an upstream-side outer space 246 is formed in the air flow upstream of cross-flow fan 100, an inner space 247 is formed in the inside of cross-flow fan 100 (on the inner circumferential side of the plurality of fan blades 21 aligned in the circumferential direction), and a downstream-side outer space 248 is formed in the air flow downstream of cross-flow fan 100.

During rotation of cross-flow fan 100, an air flow 261 passing over blade surface 23 of fan blade 21 from upstream-side outer space 246 toward inner space 247 is formed in an upstream-side region 241 of air-blow passage 226 with projections 253, 254 serving as a boundary, and air flow 261 passing over blade surface 23 of fan blade 21 from inner space 247 toward downstream-side outer space 248 is formed in a downstream-side region 242 of air-blow passage 226 with projections 253, 254 serving as a boundary. Here, a forced vortex 262 of an air flow is formed at a position adjacent to front wall portion 251.

Though an air conditioner has been described by way of example in the present embodiment, other than this, the cross-flow fan according to the present invention is also applicable to such apparatuses for sending a fluid as an air cleaner, a humidifier, a cooling apparatus, and a ventilating apparatus.

Figure 8:
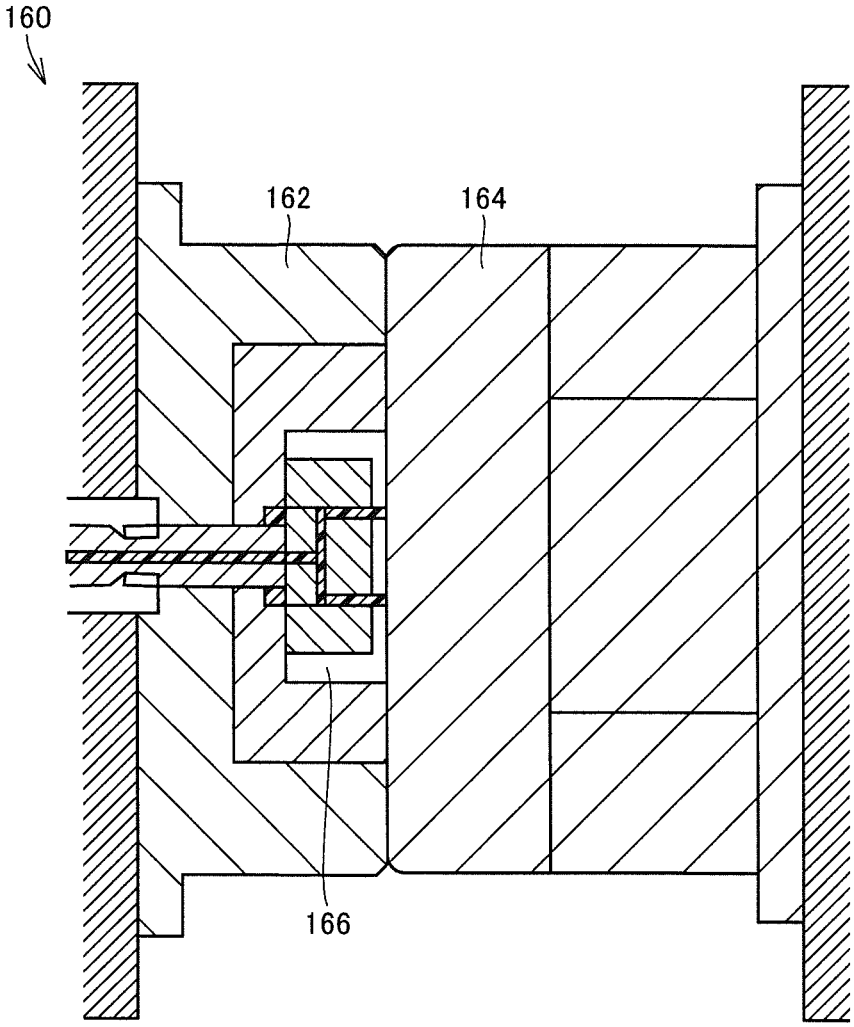
FIG. 8 is a cross-sectional view showing a molding die used in manufacturing of the cross-flow fan in FIG. 1.

FIG. 8 is a cross-sectional view showing a molding die used in manufacturing of the cross-flow fan in FIG. 1. Referring to FIG. 8, a molding die 160 has a stationary die 164 and a movable die 162. Stationary die 164 and movable die 162 define a cavity 166 formed in a shape substantially equal to that of cross-flow fan 100, into which fluid resin is injected.

Molding die 160 may be provided with a not-shown heater for enhancing fluidity of the resin injected into cavity 166. Such placement of the heater is effective particularly when synthetic resins having enhanced strengths such as AS (a copolymer compound of acrylonitrile and styrene) resin filled with glass fibers are employed.

It is noted that a centrifugal fan 10 in a third embodiment which will be described later is also manufactured with a die similar in structure to molding die 160 in FIG. 8.

(Detailed Description of Function and Effect)

In succession, a function and effect achieved by cross-flow fan 100 in the present embodiment will be described assuming a case where cross-flow fan 100 is applied to the air conditioner in FIGS. 5 to 7.

Referring to FIGS. 5 to 7, initially, a phenomenon which takes place in downstream-side region 242 of air conditioner 210 will be described. As cross-flow fan 100 rotates, a blade end on the outer edge portion 26 side of each fan blade 21 successively passes, which causes periodic pressure fluctuation mainly in a short-distance portion 206 where casing 222 and fan blade 21 are close to each other (a space where front wall portion 251 of casing 222 and fan blade 21 face each other). This periodic pressure fluctuation is the cause of generation of narrow-band noise called vane passing sound.

Figure 9:
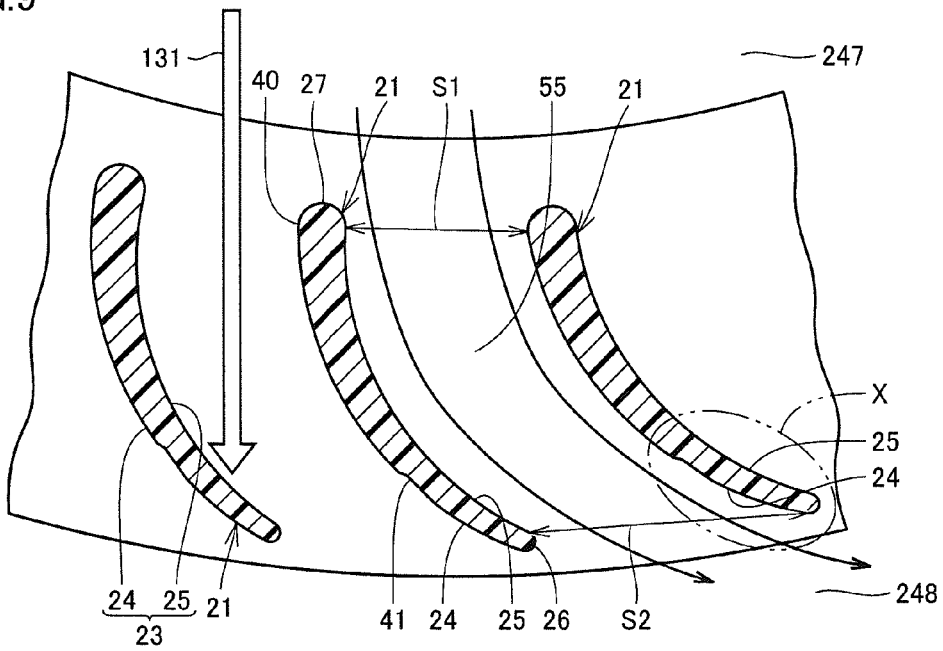
FIG. 9 is a cross-sectional view showing a downstream-side region shown in FIG. 7.
Figure 10:
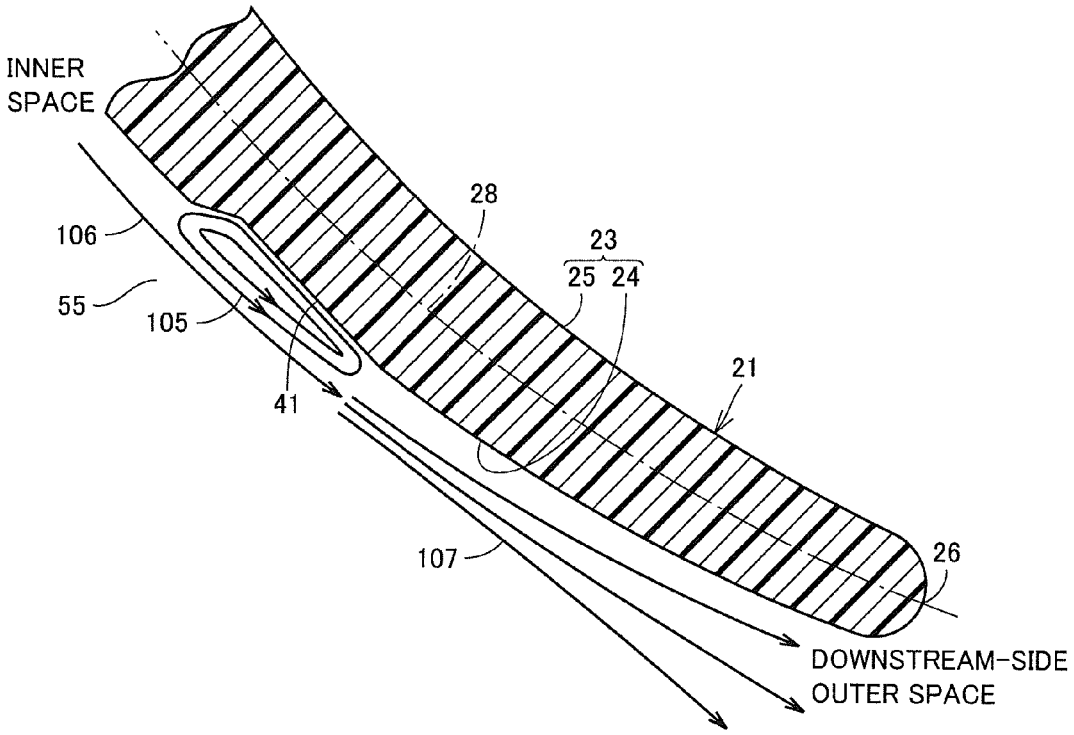
FIG. 10 is a cross-sectional view representing a phenomenon which takes place in an area surrounded by a chain double dotted line X in FIG. 9.

FIG. 9 is a cross-sectional view showing a downstream-side region shown in FIG. 7. FIG. 10 is a cross-sectional view representing a phenomenon which takes place in an area surrounded by a chain double dotted line X in FIG. 9.

Referring to FIGS. 9 and 10, in downstream-side region 242, when an air flow from inner space 247 toward downstream-side outer space 248 is formed, an air flow which flows from inner edge portion 27, passes over blade surface 23, and flows out of outer edge portion 26 is generated over blade surface 23 of fan blade 21. Here, counterclockwise vortex 105 of an air flow (secondary flow) is formed in recess 41 formed in negative pressure surface 24. Thus, an air flow 106 (main flow) which passes over blade surface 23 flows along the outside of vortex 105 generated in recess 41 and the air flow over blade surface 23 exhibits such a behavior as if recess 41 were closed by the vortex.

The reason why vortex 105 is formed in recess 41 is described. As described previously, cross-flow fan 100 is used at the number of revolutions in the range of low Reynolds numbers applied to a fan in home electric appliances or the like and a scale of recess 41 is smaller than at least thickness T of fan blade 21. Therefore, the Reynolds number of an air flow in recess 41 is smaller, for example, by the order of $10^{-1}$ with respect to the Reynolds number of an air flow around fan blade 21 for which a distance between inner edge portion 27 and outer edge portion 26 is considered in terms of a dimension scale. Therefore, an air flow within recess 41 becomes such a flow that viscosity is dominant, and a vortex in conformity with a recessed shape of recess 41 is formed.

A size or a shape of vortex 105 thus generated in recess 41 changes under the influence by a velocity of an air flow which passes through an air flow path 55 between adjacent fan blades 21 or slight disturbance. In this case, with change in size or shape of vortex 105, air flow 106 which flows along the outside of vortex 105 also significantly changes. Therefore, temporal fluctuation is caused in a direction or a velocity of an air flow 107 which passes over blade surface 23 in the downstream of recess 41. Accordingly, in short-distance portion 206 above present in the downstream of outer edge portion 26 of fan blade 21, timing of pressure fluctuation changes. Consequently, periods of pressure fluctuation are less likely to coincide and narrow-band noise can be reduced accordingly.

In addition, recess 41 is formed in negative pressure surface 24. In this case, a pressure applied to an air flow which passes over blade surface 23 is lower on negative pressure surface 24 than on positive pressure surface 25. Therefore, with change in size or shape of vortex 105 formed in recess 41, separation and reattachment of an air flow from and to blade surface 23 take place in the downstream of recess 41. Therefore, greater temporal fluctuation is caused in a direction or a velocity of air flow 107 which passes over blade surface 23 and generation of narrow-band noise can more effectively be suppressed.

Moreover, as shown with an arrow 131 in FIG. 9, centrifugal force toward a radially outward direction with central axis 101 being defined as the center is applied to air which passes between adjacent fan blades 21. In this case, since positive pressure surface 25 is arranged to face the inner circumferential side, air to which centrifugal force is applied flows as if it strongly impinged on the outer circumferential side of positive pressure surface 25. Thus, in the case where a recess is provided in outer circumferential side region 52 of positive pressure surface 25, there is a concern that dust is accumulated in that recess.

On the other hand, since negative pressure surface 24 is arranged to face the outer circumferential side on a rear surface of positive pressure surface 25, air does not strongly impinge on negative pressure surface 24. Therefore, an effect of noise reduction owing to provision of recess 41 can be obtained without concerns about deposition of dust in recess 41.

Thus, in the present embodiment, noise can be reduced by forming recess 41 on the outer circumferential side of fan blade 21. Therefore, it is not necessary to considerably differ a form of providing fan blade 21 among the plurality of fan blades 21 so as to distribute periods of passage of the blade end. Thus, a form of providing fan blade 21, that is, such design specifications as a shape (a cross-sectional shape of the blade when cut in a plane orthogonal to central axis 101), arrangement (a pitch between adjacent fan blades 21), and an angle of arrangement (an angle between a straight line connecting inner edge portion 27 and outer edge portion 26 to each other and a line connecting inner edge portion 27 and central axis 101 to each other), of fan blades 21 can be optimized in all fan blades 21. In addition, by forming recess 41 in fan blade 21, fan blade 21 can be lighter in weight.

It is noted that, in cross-flow fan 100 in the present embodiment, the plurality of fan blades 21 are arranged at random pitches around central axis 101, however, even in such a case, for the above-described reasons, an extent of random pitches can be lessened to bring alignment of each fan blade 21 to an optimal value in consideration of air blow performance.

Figure 11:
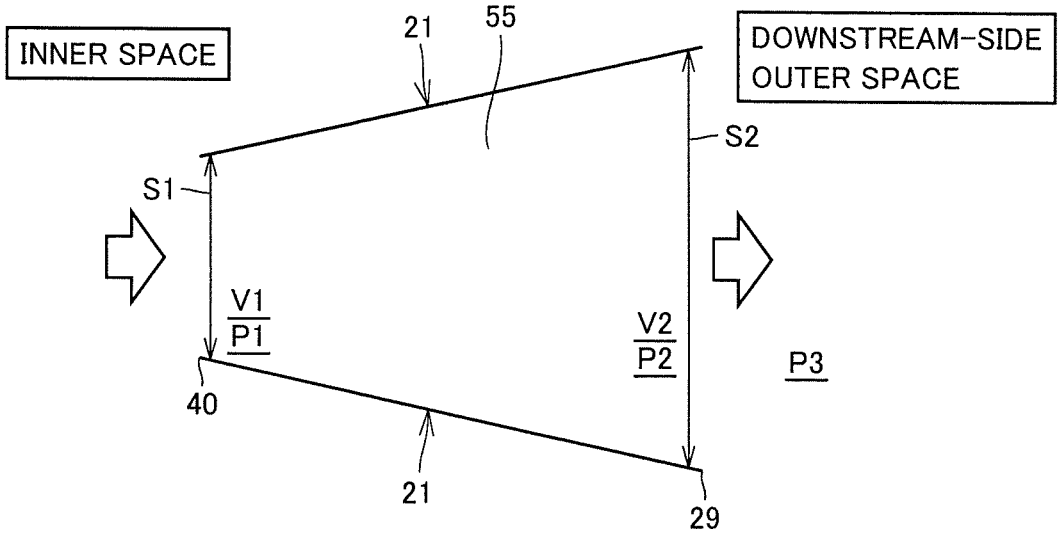
FIG. 11 is a diagram schematically representing an air flow path in the area shown in FIG. 9.

FIG. 11 is a diagram schematically representing an air flow path in the area shown in FIG. 9. Referring to FIGS. 9 and 11, in cross-flow fan 100 in the present embodiment, large-thickness portion 40 where thickness of fan blade 21 is greatest is arranged closer to inner edge portion 27, of inner edge portion 27 and outer edge portion 26. Therefore, air flow path 55 formed between adjacent fan blades 21 has a flow path area S1 relatively small on the inner circumferential side and a flow path area S2 relatively great on the outer circumferential side. According to such a construction, air from inner edge portion 27 toward outer edge portion 26 flows through an enlarging flow path of which flow path cross-section increases from upstream to downstream.

A pressure and a velocity of an air flow on the inner circumferential side of air flow path 55 are defined as P1 and V1, respectively, a pressure and a velocity of an air flow on the outer circumferential side of air flow path 55 are defined as P2 and V2, respectively, and a pressure in downstream-side outer space 248 is defined as P3. In this case, a velocity of an air flow becomes lower from the inner circumferential side toward the outer circumferential side of air flow path 55, while a pressure of the air flow increases (V1>V2, P1<P2). Thus, pressure P2 of the air flow sent through air flow path 55 between adjacent fan blades 21 becomes higher than pressure P3 in downstream-side outer space 248, and consequently static pressure characteristics of cross-flow fan 100 can be improved.

Since a flow velocity of an air flow is higher in downstream-side region 242 than in upstream-side region 241, separation of the air flow on blade surface 23 is more likely. In the present embodiment, by obtaining an effect of pressure recovery achieved by the enlarging flow path described above in downstream-side region 242 where such separation of the air flow is more likely, air blow capability of cross-flow fan 100 is significantly improved.

(Description of Detailed Structure of Cross-Flow Fan)

Figure 12:
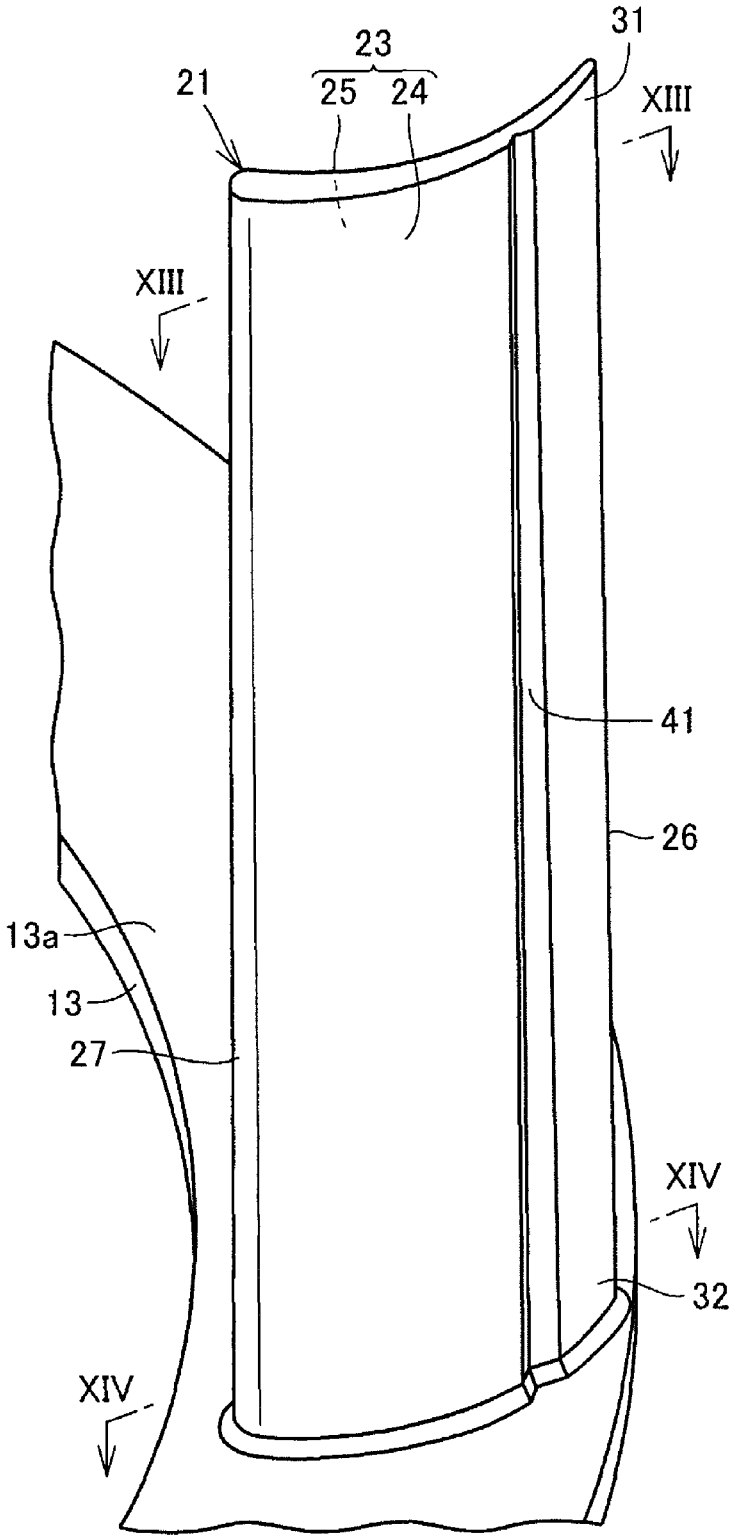
FIG. 12 is a perspective view showing the fan blade in FIG. 2.
Figure 13:
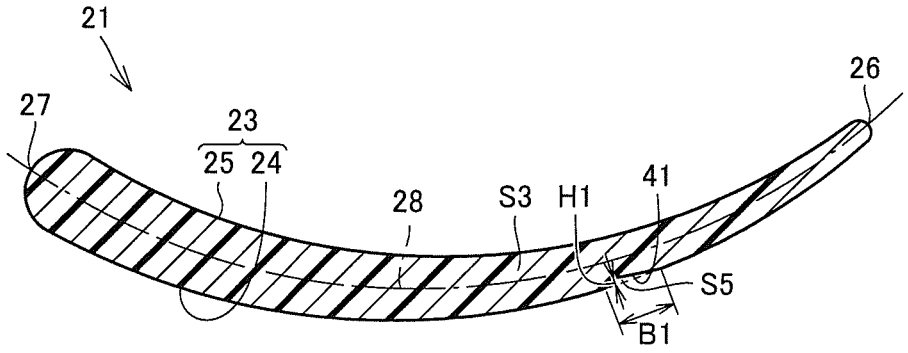
FIG. 13 is a cross-sectional view showing the fan blade along the line XIII-XIII in FIG. 12.
Figure 14:
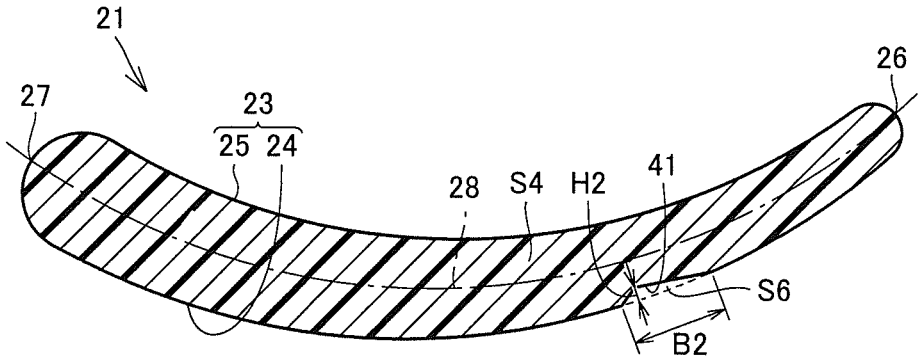
FIG. 14 is a cross-sectional view showing the fan blade along the line XIV-XIV in FIG. 12.

FIG. 12 is a perspective view showing the fan blade in FIG. 2. FIG. 13 is a cross-sectional view showing the fan blade along the line XIII-XIII in FIG. 12. FIG. 14 is a cross-sectional view showing the fan blade along the line XIV-XIV in FIG. 12. FIG. 13 shows a cross-section on a one end 31 side of fan blade 21, while FIG. 14 shows a cross-section on the other end 32 side of fan blade 21.

Referring to FIGS. 12 to 14, recess 41 is formed such that its cross-sectional shape changes from one end 31 toward the other end 32. More specifically, recess 41 is formed such that its groove depth is greater on the other end 32 side than on the one end 31 side (H1<H2). Recess 41 is formed such that a width of opening on its blade surface 23 is greater on the other end 32 side than on the one end 31 side (B1<B2). Recess 41 is formed such that across-sectional shape continuously changes in the axial direction of central axis 101.

According to such a construction, a size or a shape of vortex 105 (see FIG. 10) generated in recess 41 can be changed in the direction of the rotation axis of the fan. Thus, since temporal fluctuation is caused in a direction or a velocity of air flow 107 which passes over blade surface 23 also in the direction of the rotation axis of the fan (the axial direction of central axis 101), generation of narrow-band noise can further effectively be suppressed.

In addition, fan blade 21 is formed with resin molding by using molding die 160 shown in FIG. 8. Here, in consideration of a draft of movable die 162, fan blade 21 is formed to have such a tapered shape as being inclined with respect to the axial direction of central axis 101. More specifically, fan blade 21 is formed such that a cross-sectional area obtained in the case where it is cut in a plane orthogonal to central axis 101 increases from one end 31 toward the other end 32 (S3<S4).

On the other hand, in cross-flow fan 100 in the present embodiment, recess 41 is formed such that its cross-sectional area is greater on the other end 32 side than on the one end 31 side (S5<S6). According to such a construction, a shape of recess 41 is changed such that a cross-sectional area of recess 41 is great on the other end 32 side having a greater cross-sectional area. By thus changing a cross-sectional shape of recess 41 along the draft in connection with resin molding of fan blade 21, an excessively thin portion can be prevented from being formed in a cross-section of fan blade 21. Thus, weight of fan blade 21 can significantly be reduced while strength thereof is ensured. In addition, in the case of resin molding cross-flow fan 100 by using molding die 160 in FIG. 8, fluidity of the resin on the thin one end 31 side can be ensured.

A structure of cross-flow fan 100 in the first embodiment of this invention described above is summarized. Cross-flow fan 100 serving as a fan in the present embodiment has fan blades 21 as a plurality of vane portions provided at a distance from one another in a circumferential direction. Fan blade 21 has inner edge portion 27 arranged on the inner circumferential side and outer edge portion 26 arranged on the outer circumferential side. Blade surface 23 extending between inner edge portion 27 and outer edge portion 26 is formed in fan blade 21. As the fan rotates, an air flow as a fluid flow which flows between inner edge portion 27 and outer edge portion 26 is generated over blade surface 23. Fan blade 21 has such a blade cross-sectional shape that recess 41 is formed in blade surface 23 when it is cut in a plane orthogonal to central axis 101 serving as a rotation axis of the fan. Recess 41 is arranged at a position closer to outer edge portion 26 than to inner edge portion 27 and formed to extend from one end 31 to the other end 32 of fan blade 21 in the direction of the rotation axis of the fan.

According to cross-flow fan 100 in the first embodiment of this invention thus constructed, by distributing frequencies of the nZ sounds among the plurality of fan blades 21, noise in connection with drive of the fan is reduced and sound quality of the noise can be better. Here, since it is not necessary to considerably change the form of providing fan blades 21 among the plurality of fan blades 21 in order to reduce noise, a blade cross-sectional shape, alignment, an angle of arrangement, and the like of fan blades 21 before recess 41 is formed can readily be set to an optimal value in consideration of air blow capability. In addition, at the same time, by forming recess 41 in fan blade 21, fan blade 21 can be lighter in weight.

Moreover, according to air conditioner 210 in the first embodiment of this invention, by employing cross-flow fan 100 having light weight and exhibiting excellent air flow capability, power consumption in the drive motor for driving cross-flow fan 100 can be reduced. Thus, air conditioner 210 capable of contributing to energy saving can be realized.

Though a case where large-thickness portion 40 of fan blade 21 is arranged closer to inner edge portion 27 has been described in the present embodiment, the present invention is not limited thereto and large-thickness portion 40 may be arranged closer to outer edge portion 26. In addition, recess 41 may be formed in positive pressure surface 25 in outer circumferential side region 52 or in positive pressure surface 25 and negative pressure surface 24 in outer circumferential side region 52. Furthermore, an additional recess may be formed in positive pressure surface 25 in inner circumferential side region 51 of fan blade 21 shown in FIG. 4.

[Second Embodiment]

A variation of cross-flow fan 100 in the first embodiment will be described in the present embodiment.

Figure 15:
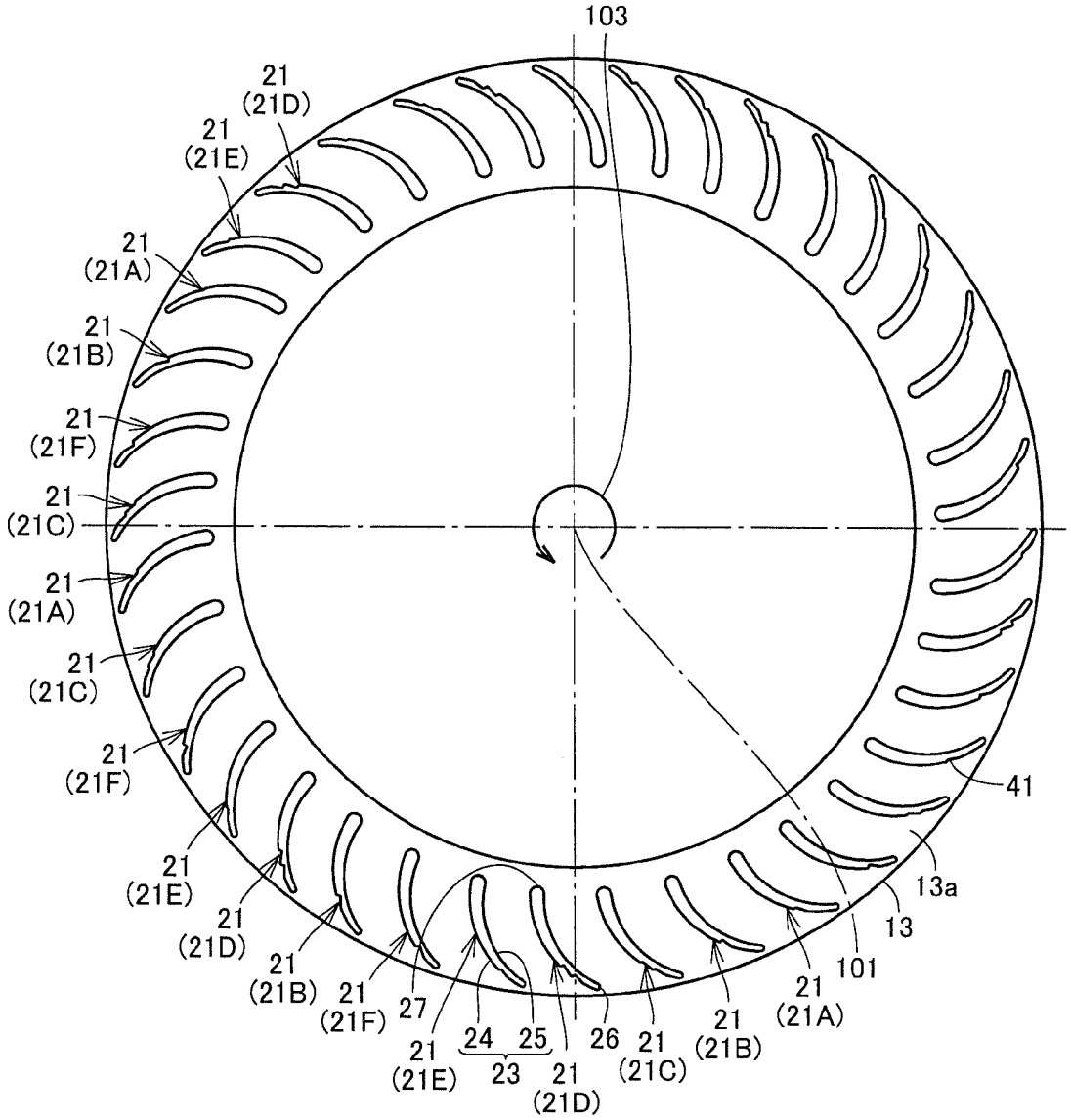
FIG. 15 is a cross-sectional view showing a variation of the cross-flow fan in FIG. 1.
Figure 16:
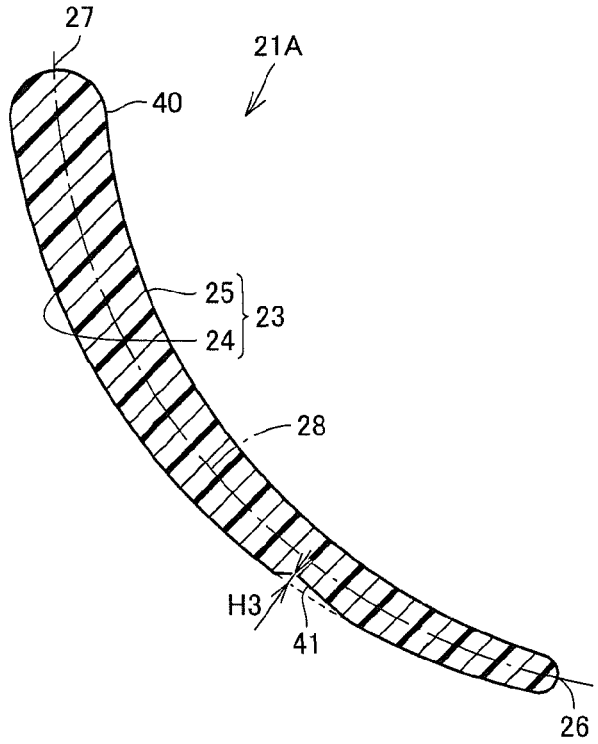
FIG. 16 is a cross-sectional view showing a first fan blade included in the cross-flow fan in FIG. 15.
Figure 17:
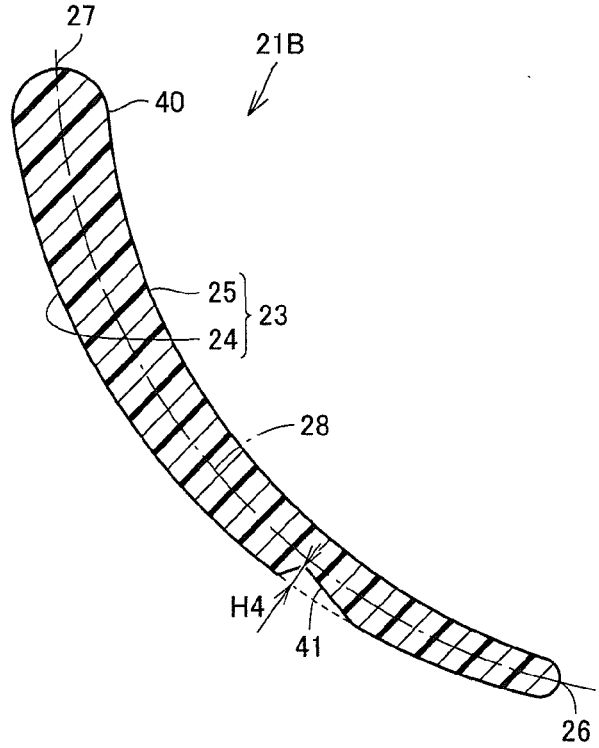
FIG. 17 is a cross-sectional view showing a second fan blade included in the cross-flow fan in FIG. 15.
Figure 18:
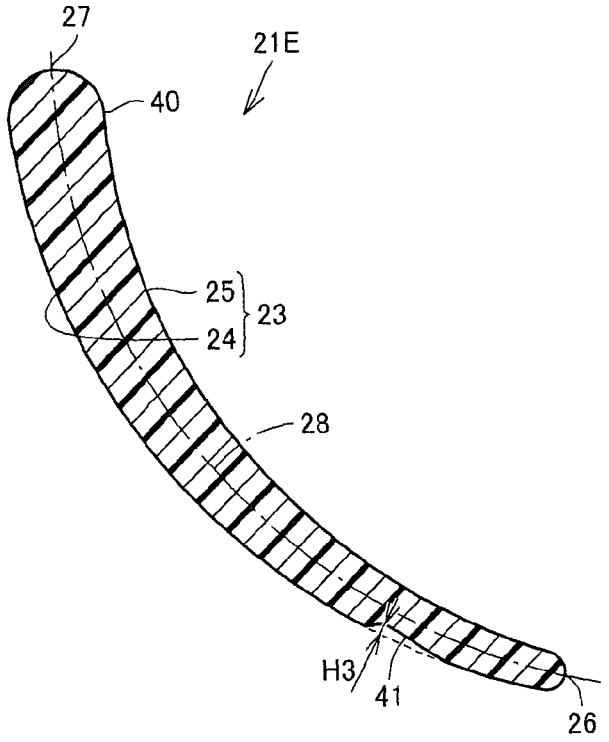
FIG. 18 is a cross-sectional view showing a third fan blade included in the cross-flow fan in FIG. 15.
Figure 19:
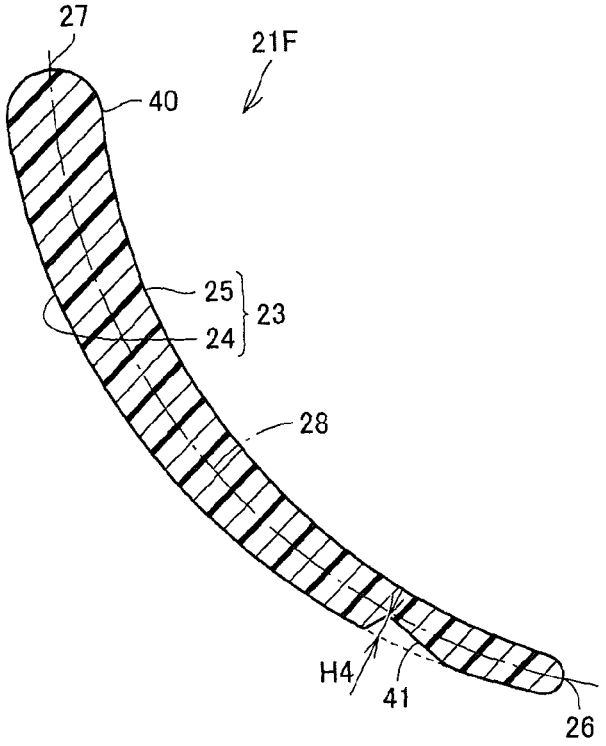
FIG. 19 is a cross-sectional view showing a fourth fan blade included in the cross-flow fan in FIG. 15.
Figure 20:
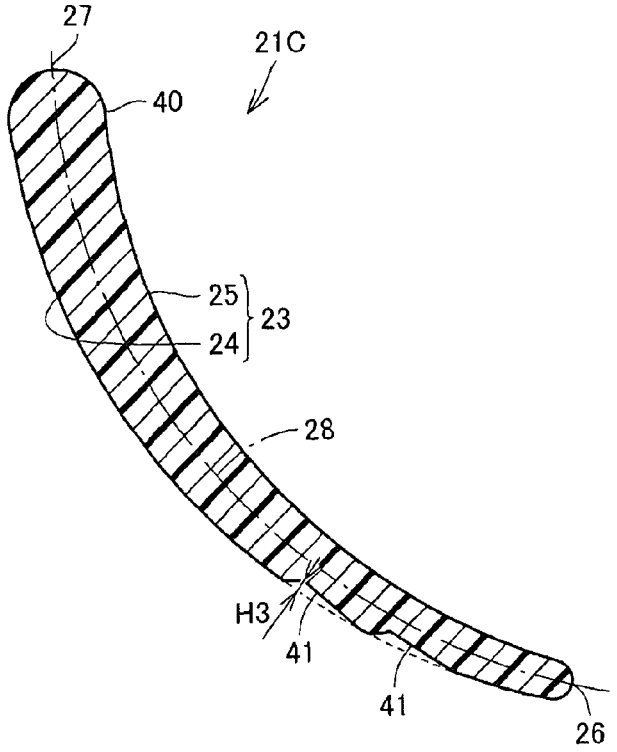
FIG. 20 is a cross-sectional view showing a fifth fan blade included in the cross-flow fan in FIG. 15.
Figure 21:
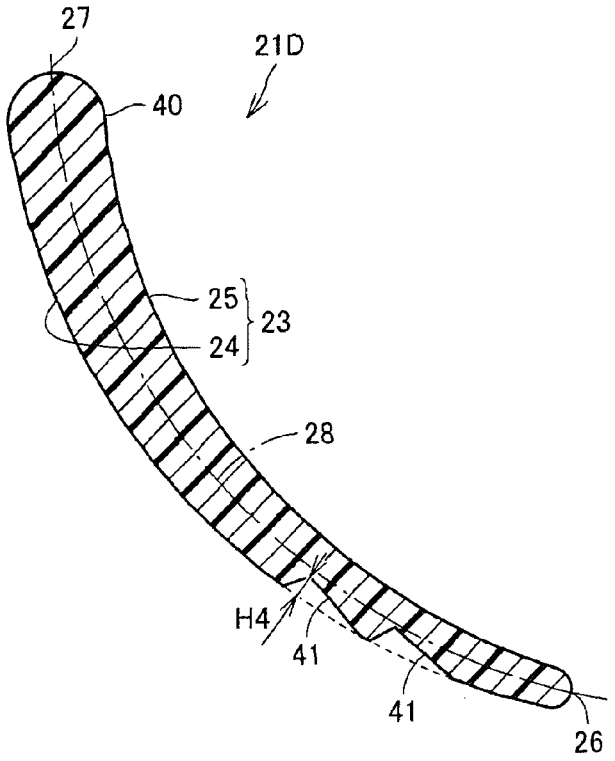
FIG. 21 is a cross-sectional view showing a sixth fan blade included in the cross-flow fan in FIG. 15.

FIG. 15 is a cross-sectional view showing a variation of the cross-flow fan in FIG. 1. FIGS. 16 to 21 are cross-sectional views showing various fan blades included in the cross-flow fan in FIG. 15.

Referring to FIG. 15, in the cross-flow fan in the present variation, the plurality of fan blades 21 are constituted of a plurality of types of fan blades 21A, 21B, 21C, 21D, 21E, 21F. In fan blades 21A to 21F, recesses 41 are formed in forms different from one another. There are provided a plurality of fan blades 21A to a plurality of fan blades 21F.

A form of providing recess 41 means a shape of recess 41 (a cross-sectional shape, a groove depth, a width of opening, and the like), a position where recess 41 is formed, and the number of recesses 41. As shown in FIGS. 16 through 21, in the present variation, one recess 41 is formed in each of fan blades 21A, 21B, 21E, 21F, and two recesses 41 are formed in each of fan blades 21C, 21D. In fan blades 21A, 21B, recess 41 is formed at a position distant from outer edge portion 26, as compared with fan blades 21E, 21F. In fan blades 21C, 21D, respective recesses 41 are formed at a position where recess 41 is formed in fan blade 21A, 21B and a position where recess 41 is formed in fan blade 21E, 21F. In fan blades 21B, 21F, 21D, recess 41 relatively great in groove depth is formed, and in fan blades 21A, 21E, 21C, recess 41 relatively small in groove depth is formed (H4>H3).

Fan blades 21A, 21B, 21C, 21D, 21E, 21F are aligned in an irregular (random) order in the circumferential direction around central axis 101. Namely, fan blades 21A to 21F are aligned such that they are not repeatedly aligned in a regular order (for example, such an order as fan blade 21A→21B→21C→21D→21E→21A→21B→21C→21D→21E→21A→21B . . . ).

In the cross-flow fan shown in the figure, in a prescribed section, in a clockwise direction around central axis 101, fan blades 21A, 21B, 21C, 21D, 21E, 21F, 21B, 21D, 21E, 21F, 21C, 21A, 21C, 21F, 21B, 21A, 21E, 21D are sequentially aligned.

In the example above, a method of sequentially arranging a plurality of sets different in sequence of fan blades 21A to 21F with six types of fan blades 21A to 21F being defined as one set is adopted as a method of randomly arranging fan blades 21A to 21F. Other than this method, a method of preparing a plurality of fan blades 21A to a plurality of fan blades 21F and selecting an appropriate fan blade among them and aligning them sequentially may be employed. If fan blades 21A to 21F are aligned without regularity as a whole, a specific type of fan blades may successively be aligned. Recesses 41 different in form from one another may be provided in all of fan blades 21 employed in the cross-flow fan. The number of types of fan blades 21 used is preferably three or more and more preferably four or more.

According to such a construction, as the form of providing recess 41 differs, a shape or a size of a vortex of an air flow formed in recess 41 is different among fan blades 21A to 21F. In this case, since an air flow along the outside of that vortex is also affected by the shape or the size of the vortex, a direction or a velocity of an air flow in the downstream of recess 41 varies among fan blades 21A to 21F. Thus, frequencies of passing sounds of fan blades 21 can be distributed and noise in connection with drive of the fan can further be suppressed.

According to the cross-flow fan in the second embodiment of this invention thus constructed, an effect described in the first embodiment can similarly be obtained.

[Third Embodiment]

In the present embodiment, a structure of a centrifugal fan to which the fan according to the present invention is applied will initially be described, and then a structure of a blower and an air cleaner including that centrifugal fan will be described. It is noted that the centrifugal fan in the present embodiment includes a structure partially similar to that of cross-flow fan 100 in the first embodiment. Description of a redundant structure will not be repeated below.

(Description of Structure of Centrifugal Fan)

Figure 22:
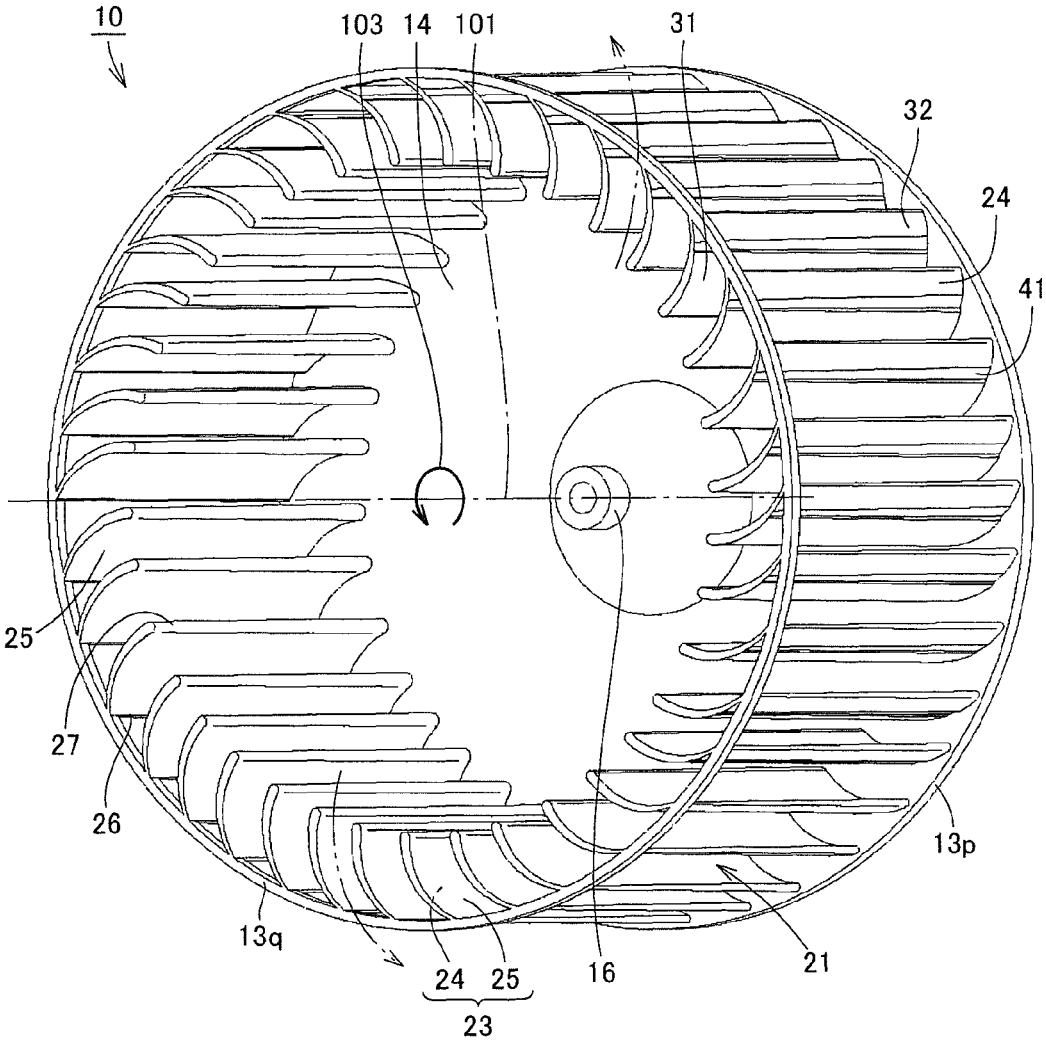
FIG. 22 is a perspective view showing a centrifugal fan in a third embodiment of this invention.

FIG. 22 is a perspective view showing a centrifugal fan in a third embodiment of this invention. Referring to FIG. 22, centrifugal fan 10 in the present embodiment has a plurality of fan blades 21. Centrifugal fan 10 has appearance in a substantially cylindrical shape as a whole, and the plurality of fan blades 21 are arranged around a circumferential surface of the substantially cylindrical shape. Centrifugal fan 10 is integrally formed from resin. Centrifugal fan 10 rotates in a direction shown with arrow 103 around virtual central axis 101 shown in FIG. 22.

Centrifugal fan 10 is a fan for sending air taken from the inner circumferential side toward the outer circumferential side by using the plurality of rotating fan blades 21. Centrifugal fan 10 is a fan sending air in a radial direction from a central side of rotation of the fan by making use of centrifugal force. Centrifugal fan 10 is a sirocco fan. Centrifugal fan 10 is used at the number of revolutions in a range of low Reynolds numbers applied to fans in home electric appliances or the like.

Centrifugal fan 10 further has an outer circumferential frame 13*p* and an outer circumferential frame 13*q* each serving as a support portion. Outer circumferential frame 13*p* and outer circumferential frame 13*q* are formed to annularly extend around central axis 101. Outer circumferential frame 13*p* and outer circumferential frame 13*q* are arranged at positions distant from each other in the axial direction of central axis 101. In outer circumferential frame 13*p*, a boss portion 16 for coupling centrifugal fan 10 to the drive motor with a disk portion 14 being interposed is integrally formed.

The plurality of fan blades 21 are aligned at a distance from one another in the circumferential direction around central axis 101. The plurality of fan blades 21 are supported by outer circumferential frame 13*p* and outer circumferential frame 13*q* at opposing ends in the axial direction of central axis 101. Fan blade 21 is formed to be erected on outer circumferential frame 13*p* and to extend along the axial direction of central axis 101 toward outer circumferential frame 13*q*.

Fan blade 21 has a blade cross-sectional shape the same as that of fan blade 21 in FIG. 4 in the first embodiment. Namely, large-thickness portion 40 at which a thickness of fan blade 21 is greatest is arranged closer to inner edge portion 27, of inner edge portion 27 and outer edge portion 26. Recess 41 is formed in negative pressure surface 24 in outer circumferential side region 52 in fan blade 21.

Centrifugal fan 10 in the present embodiment is different from cross-flow fan 100 in the first embodiment in that the plurality of fan blades 21 are aligned at regular intervals.

(Description of Structure of Blower and Air Cleaner)

Figure 23:
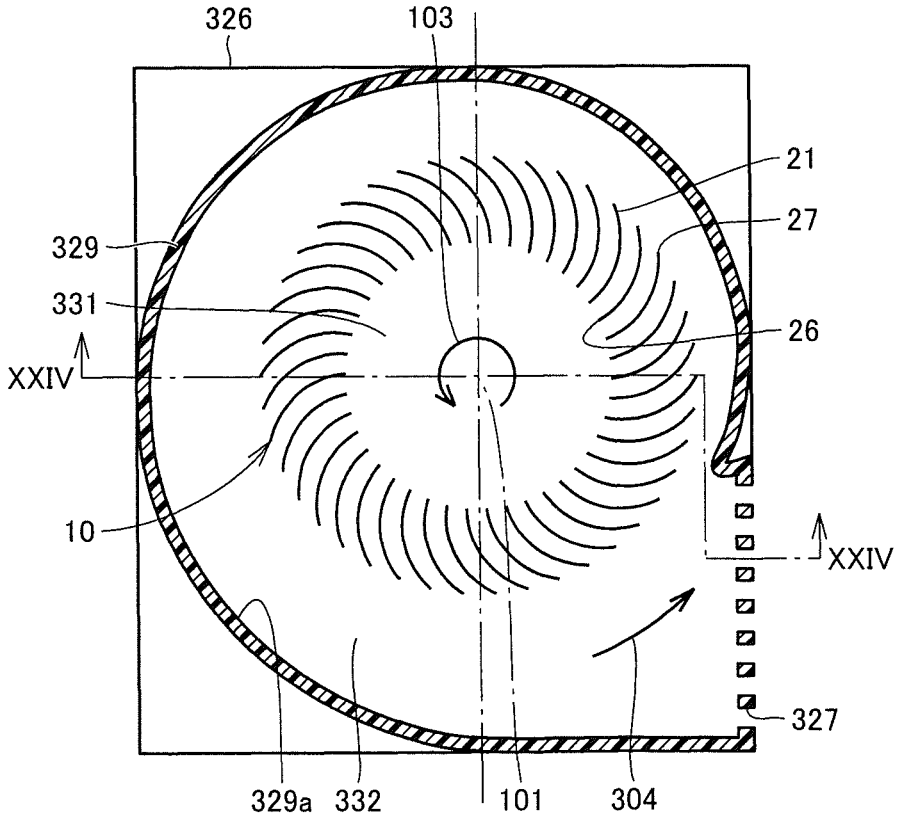
FIG. 23 is a cross-sectional view showing a blower in which the centrifugal fan in FIG. 22 is employed.
Figure 24:
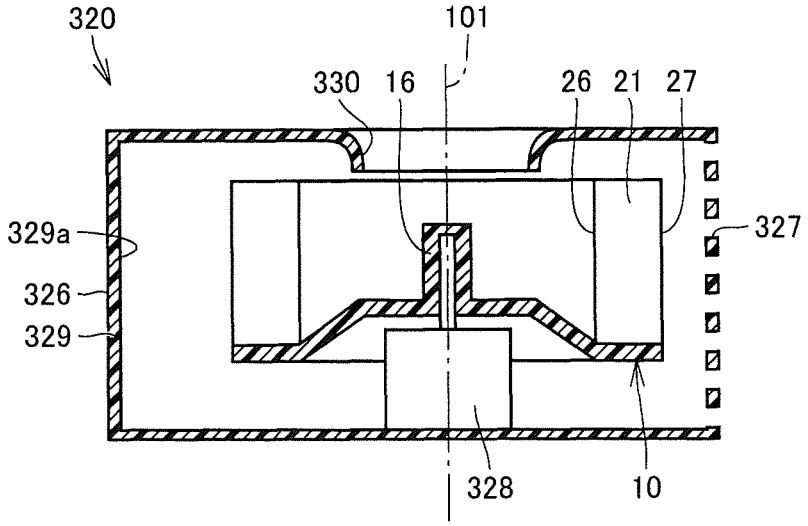
FIG. 24 is a cross-sectional view showing the blower along the line XXIV-XXIV in FIG. 23.

FIG. 23 is a cross-sectional view showing a blower in which the centrifugal fan in FIG. 22 is employed. FIG. 24 is a cross-sectional view showing the blower along the line XXIV-XXIV in FIG. 23. Referring to FIGS. 23 and 24, a blower 320 has a drive motor 328, centrifugal fan 10, and a casing 329 in an outer casing 326.

An output shaft of drive motor 328 is coupled to boss portion 16 molded integrally with centrifugal fan 10. Casing 329 has a guide wall 329*a*. Guide wall 329*a* is formed substantially from a ¾ arc arranged around the outer circumference of centrifugal fan 10. Guide wall 329*a* increases a velocity of an air current while guiding an air current generated as a result of rotation of fan blade 21 in a direction of rotation of fan blade 21.

An intake portion 330 and an outlet portion 327 are formed in casing 329. Intake portion 330 is formed as being located on an extension of central axis 101. Outlet portion 327 is formed to open in a part of guide wall 329 into one tangential direction of guide wall 329*a*. Outlet portion 327 forms a prismatic shape protruding from a part of guide wall 329*a* to one tangential direction of guide wall 329*a*.

As drive motor 328 is driven, centrifugal fan 10 rotates in the direction shown with arrow 103. Here, air is taken from intake portion 330 into casing 329 and sent from an inner circumferential side space 331 to an outer circumferential side space 332 of centrifugal fan 10. Air sent to outer circumferential side space 332 flows in the circumferential direction along a direction shown with an arrow 304 and sent to the outside through outlet portion 327.

Figure 25:
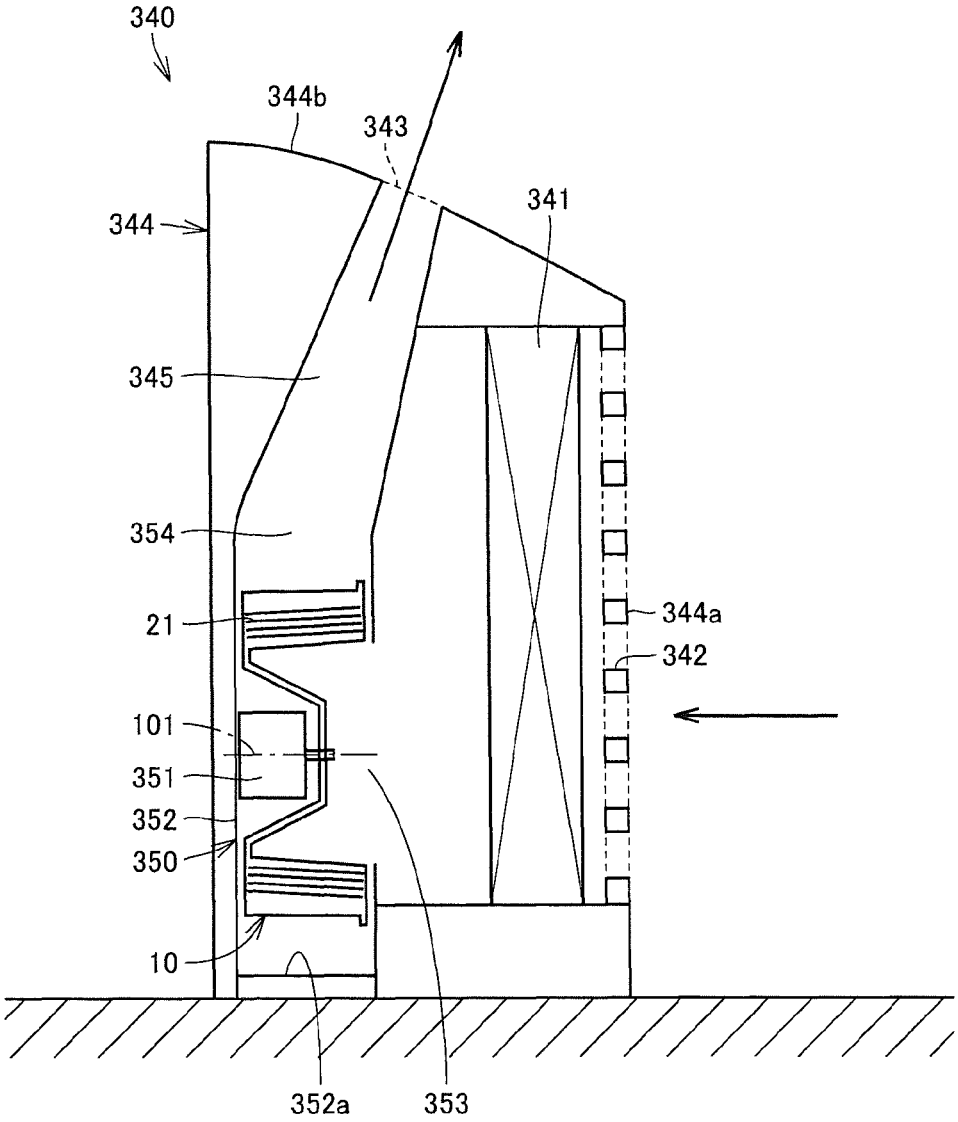
FIG. 25 is a cross-sectional view showing an air cleaner in which the centrifugal fan in FIG. 23 is employed.

FIG. 25 is a cross-sectional view showing an air cleaner in which the centrifugal fan in FIG. 23 is employed. Referring to FIG. 25, an air cleaner 340 has a housing 344, a blower 350, a duct 345, and an (HEPA: High Efficiency Particulate Air Filter) filter 341.

Housing 344 has a rear wall 344*a* and a top wall 344*b*. Housing 344 has an intake port 342 formed, for taking in air in a room in which air cleaner 340 is installed. Intake port 342 is formed in rear wall 344*a*. Housing 344 further has an outlet port 343 formed, for discharging cleaned air into the room. Outlet port 343 is formed in top wall 344*b*. Air cleaner 340 is generally installed against a wall such that rear wall 344*a* is opposed to a wall in the room.

Filter 341 is arranged to face intake port 342 in the inside of housing 344. The air introduced into housing 344 through intake port 342 passes through filter 341. Thus, foreign matters in air are removed.

Blower 350 is provided for taking air in the room to the inside of housing 344 and sending the air cleaned by filter 341 into the room through outlet port 343. Blower 350 has centrifugal fan 10, a casing 352, and a drive motor 351. Casing 352 has a guide wall 352*a*. Casing 352 has an intake portion 353 and an outlet portion 354.

Duct 345 is provided above blower 350 and is provided as an air channel for guiding the cleaned air from casing 352 to outlet port 343. Duct 345 has a prismatic shape with its lower end connecting to outlet portion 354 and with its upper end open. Duct 345 is formed to guide the cleaned air blown from outlet portion 354 to a laminar flow toward outlet port 343.

In air cleaner 340 having such a construction, as blower 350 is driven, fan blade 21 rotates to cause air in the room to be taken in from intake port 342 to the inside of housing 344. Here, an air flow is generated between intake port 342 and outlet port 343, and foreign matters such as dust included in the intake air are removed by filter 341.

The cleaned air obtained by passage through filter 341 is taken into the inside of casing 352. Here, the cleaned air taken into the inside of casing 352 forms a laminar flow through guide wall 352*a* around fan blade 21. The air in the form of a laminar flow is guided to outlet portion 354 along guide wall 352*a* and blown from outlet portion 354 to the inside of duct 345. The air is discharged from outlet port 343 toward an outer space.

Though the air cleaner has been described in the present embodiment by way of example, other than this, for example, the centrifugal fan according to the present invention can be applied to such an apparatus for sending a fluid as an air conditioner, a humidifier, a cooling apparatus, and a ventilating apparatus.

According to centrifugal fan 10 and air cleaner 340 in the third embodiment of this invention thus constructed, an effect described in the first embodiment can similarly be obtained.

A new fan may be constructed by combining as appropriate structures of the fans described in the first to third embodiments described above. For example, the fan blade described in the second embodiment may be employed to construct centrifugal fan 10 in the third embodiment.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

This invention is mainly applied to home electric appliances having an air blowing function, such as an air cleaner and an air conditioner.

REFERENCE SIGNS LIST

10 centrifugal fan; 12, 12A, 12B, 12C impeller; 13, 13*p*, 13*q* outer circumferential frame; 13*a*, 13*b* end surface; 14 disk portion; 16 boss portion; 21, 21A to 21F fan blade; 23 blade surface; 24 negative pressure surface; 25 positive pressure surface; 26 outer edge portion; 27 inner edge portion; 28 centerline; 31 one end; 32 the other end; 40 large-thickness portion; 41 recess; 51 inner circumferential side region; 52 outer circumferential side region; 55 air flow path; 100 cross-flow fan; 101 central axis; 105 vortex; 160 molding die; 162 movable die; 164 stationary die; 166 cavity; 206 short-distance portion; 210 air conditioner; 215 blower; 220 indoor unit; 222 casing; 222A cabinet; 222B front panel; 224 intake port; 225 outlet port; 226 air-blow passage; 228 air filter; 229 indoor heat exchanger; 231 lateral louver; 232 vertical louver; 242 upstream-side region; 242 downstream-side region; 246 upstream-side outer space; 247 inner space; 248 downstream-side outer space; 251 front wall portion; 252 rear wall portion; 253, 254 projection; 256 upper guide portion; 257 lower guide portion; 262 forced vortex; 320 blower; 326 outer casing; 327 outlet portion; 328 drive motor; 329 casing; 329*a* guide wall; 330 intake portion; 331 inner circumferential side space; 332 outer circumferential side space; 340 air cleaner; 341 filter; 342 intake port; 343 outlet port; 344 housing; 344*a* rear wall; 344*b* top wall; 345 duct; 350 blower; 351 drive motor; 352 casing; 352*a* guide wall; 353 intake portion; and 354 outlet portion.

The invention claimed is:

1. A fan, comprising:

a plurality of vane portions including an inner edge portion arranged on an inner circumferential side and an outer edge portion arranged on an outer circumferential side and provided at a distance from one another in a circumferential direction, said vane portion including a blade surface, which extends between said inner edge portion and said outer edge portion, a fluid flow which flows between said inner edge portion and said outer edge portion being generated over said blade surface as the fan rotates, said vane portion including such a blade cross-sectional shape that a recess is formed in said blade surface when it is cut in a plane orthogonal to a rotation axis of the fan, and said recess being arranged at a position closer to said outer edge portion than to said inner edge portion and formed to extend from one end to the other end of said vane portion in a direction of the rotation axis of the fan, said blade surface includes a positive pressure surface arranged on a side of a direction of rotation of the fan and a negative pressure surface arranged on a back side of said positive pressure surface, of said positive pressure surface and said negative pressure surface, it is only said negative pressure surface in which said recess is formed, when cut in the plane orthogonal to the rotation axis of the fan, said vane portion includes a cross-sectional area increasing from the one end toward the other end of said vane portion in the direction of the rotation axis of the fan, and said recess is formed such that a cross-sectional area of said recess recessed in said blade surface is greater on a side of the other end than on a side of the one end of said vane portion.

2. The fan according to claim 1, wherein said recess is formed such that its cross-sectional shape changes from the one end to the other end of said vane portion in the direction of the rotation axis of the fan.

3. The fan according to claim 2, wherein said recess is formed such that a width of opening in said blade surface changes from the one end to the other end of said vane portion in the direction of the rotation axis of the fan.

4. The fan according to claim 1, wherein the plurality of said vane portions includes a first vane portion and a second vane portion different in the form of said recess formed in said vane portion.

5. The fan according to claim 1, wherein on an inside of the plurality of said vane portions aligned in the circumferential direction, an inner space is formed, and on an outside thereof, an outer space is formed, and the fan is a cross-flow fan for taking a fluid from said outer space on one side with respect to the rotation axis into said inner space when viewed in the direction of the rotation axis of the fan and sending the taken fluid to said outer space on the other side with respect to the rotation axis.

6. The fan according to claim 1, wherein on an inside of the plurality of said vane portions aligned in the circumferential direction, an inner space is formed, and on an outside thereof, an outer space is formed, and the fan is a centrifugal fan for sending a fluid from said inner space to said outer space.

7. The fan according to claim 1, formed from resin.

8. A molding die for use in molding the fan according to claim 7.

9. A fluid feeder, comprising a blower constituting a fan according to claim 1 and a drive motor coupled to said fan to rotate the plurality of said vane portions.

* * * * *